US005510572A

United States Patent [19]

Hayashi et al.

[11] Patent Number: 5,510,572

[45] Date of Patent: Apr. 23, 1996

[54] APPARATUS FOR ANALYZING AND HARMONIZING MELODY USING RESULTS OF MELODY ANALYSIS

[75] Inventors: Tetsuya Hayashi, Fussa; Kunihiro Matsubara, Tokyo, both of Japan

[73] Assignee: Casio Computer Co., Ltd., Tokyo, Japan

[21] Appl. No.: 134,797

[22] Filed: Oct. 8, 1993

[30] Foreign Application Priority Data

| | | | |
|---|---|---|---|
| Oct. 12, 1992 | [JP] | Japan | 4-299267 |
| Oct. 12, 1992 | [JP] | Japan | 4-299268 |
| Oct. 12, 1992 | [JP] | Japan | 4-299269 |

[51] Int. Cl.[6] ..... G10H 7/00; G10H 1/38

[52] U.S. Cl. ..... 84/609; 84/610; 84/613; 84/634; 84/666

[58] Field of Search ..... 84/600–604, 609, 84/610, 611, 613, 634–638, 649–652, 666–665

[56] References Cited

U.S. PATENT DOCUMENTS

| | | | |
|---|---|---|---|
| 4,539,882 | 9/1985 | Yuzawa . | |
| 5,218,153 | 6/1993 | Minamitaka . | |
| 5,262,583 | 11/1993 | Shimada | 84/609 |
| 5,262,584 | 11/1993 | Shimada | 84/609 |
| 5,283,388 | 2/1994 | Shimada | 84/609 |

FOREIGN PATENT DOCUMENTS

| | | |
|---|---|---|
| 58-87593 | 5/1983 | Japan . |
| 63-80299 | 4/1988 | Japan . |
| 2-157799 | 6/1990 | Japan . |
| 4-9893 | 1/1992 | Japan . |
| 5-108073 | 4/1993 | Japan . |

*Primary Examiner*—Vit W. Miska

*Attorney, Agent, or Firm*—Frishauf, Holtz, Goodman, Langer & Chick

[57] ABSTRACT

A melody segmentation module segments a given melody into a plurality of phrases. A phrase tonality analyzer determines a key of each phrase to provide a correct succession of keys of the melody. With this arrangement, the music apparatus can detect, from the melody, a modulation (change of key). A chord progression database is searched to assign an appropriate chord pattern to each phrase. Thus, the melody is harmonized with a natural and real chord progression. A style analyzer tests a melody phrase for a preselected music style and labels it with style-matched if it meets the preselected music style. A chord pattern characteristic of the preselected music style is selected from a chord progression database of the same music style to harmonize the style-matched phrase. Thus, the melody agrees with the harmonizing chord progression in terms of music style.

14 Claims, 37 Drawing Sheets

FIG.9

COUPLING DATA

JOINT [-12] = 1
JOINT [-11] = 1
JOINT [-10] = 1
JOINT [-9] = 2
JOINT [-8] = 3
JOINT [-7] = 16
JOINT [-6] = 1
JOINT [-5] = 5
JOINT [-4] = 12
JOINT [-3] = 7
JOINT [-2] = 12
JOINT [-1] = 5
JOINT [0] = 10
JOINT [1] = 18
JOINT [2] = 8
JOINT [3] = 10
JOINT [4] = 8
JOINT [5] = 16
JOINT [6] = 1
JOINT [7] = 4
JOINT [8] = 3
JOINT [9] = 2
JOINT [10] = 1
JOINT [11] = 1
JOINT [12] = 1

81

CPDB 82
RHYTHM ATTRIBUTE
LENGTH OF CP
CHORD DATA
END MARK
RHYTHM ATTRIB
LENGTH OF CP
CHORD DATA
END MARK
RHYTHM ATTRIB
MSB
LSB
0 0 0 0
LSB : ROCK
BIT2 : DISCO
BIT3 : 16 BEAT
BIT4 : SWING1
BIT5 : SWING2
BIT6 : SAMBA
BIT7 : BOSSANOVA
BIT8 : BEGUIN
BIT9 : TANGO
BIT10 : MARCH
BIT11 : SLOW ROCK
BIT12 : WALTZ
CHORD DATA
ROOT
TYPE
LENGTH
0 : C
1 : C#
2 : D
3 : E♭
4 : E
5 : F
6 : F#
7 : G
8 : A♭
9 : A
A : B♭
B : B
0 : maj
1 : min
2 : 7
3 : m7
4 : M7
5 : sus4
6 : aug
7 : dim
8 : m7♭5
9 : 7♭5
A : sus7
B : add9
C : madd9
D : dim7
END MARK
1 1 1 1 1 1 1 1 1 1 1 1 1 1 1 1 (FFFF)

j [-12] = 1
j [-11] = 1
j [-10] = 1
j [-9] = 2
j [-8] = 3
j [-7] = 16
j [-6] = 1
j [-5] = 5
j [-4] = 12
j [-3] = 7
j [-2] = 12
j [-1] = 5
j [0] = 10
j [1] = 18
j [2] = 8
j [3] = 10
j [4] = 8
j [5] = 16
j [6] = 1
j [7] = 4
j [8] = 3
j [9] = 2
j [10] = 1
j [11] = 1
j [12] = 1

APPARATUS FOR ANALYZING AND HARMONIZING MELODY USING RESULTS OF MELODY ANALYSIS

BACKGROUND OF THE INVENTION

1. Field

This invention relates to musical apparatus. In particular, the invention pertains to a melody analyzer for analyzing a melody for tonality and a melody harmonizer for harmonizing the melody using the results of the melody analysis.

2. Description of the Prior Art

A melody analyzer which determines a key of a melody is known. Such a melody analyzer is often used in an automatic accompaniment apparatus which provides an automatic accompaniment to a melody. A typical prior art melody analyzer matches the set of notes of a melody against a pitch class set (PCS) of a scale while changing its tone from a pitch class to another to determine a key of the melody. Another prior art melody analyzer utilizes the last note of a melody for key determination.

However, either prior art melody analyzer operates based on the premise that a given melody does not include any modulation (change of key). Thus, none of the prior art melody analyzers can provide satisfactory tonality analysis of a melody having modulation in its course since a wrong key is determined for a portion of such a melody.

A melody harmonizer for harmonizing a melody is known. The prior art melody harmonizer divides a melody into a plurality of segments having the same length (e.g., one or half bar) based on the premise that each segment is harmonized by a single chord. The prior art melody harmonizer determines a chord of each segment in accordance with a chord determining algorithm using pitch contents of the segment and/or a chord assigned to a preceding segment.

Thus, the resultant chord progression involves unnaturalness peculiar to the chord determining algorithm. Further, the play of an accompaniment using such chord progression sounds monotonous since a chord or harmony changes regularly per same length of time.

An automatic accompaniment apparatus is known which harmonizes a melody and automatically plays an accompaniment based on the results of harmonization and preselected accompaniment style.

The prior art apparatus, however, has no capability of anlyzing a melody for its style. Instead, it merely uses the preselected accompaniment style information to retrieve, from an accompaniment pattern memory, an accompaniment pattern of that preselected accompaniment style. This results in a monotonous accompaniment.

SUMMARY OF THE INVENTION

It is, therefore, an object of the invention is to provide a melody analyzer capable of handling a melody having modulation and capable of detecting modulation in such a melody.

An aspect of the invention provides a melody analyzer which comprises melody providing means for providing a melody, segmentation means for segmenting the melody into phrases, and phase key determining means for determining a key of each of the phrases.

In this arrangement, the segmentation means can provide melody segments or phrases such that each phrase does not have any modulation. By way of example, take up a melody of eight phrases in which the first to fourth phrases have a key of C which changes to G in the fifth and sixth phrases and returns to F in the seventh and eighth phrases. In this example, the melody includes modulation, as a whole, but no modulation occurs within each individual phrase. The phrase key determining means determines a key of each phrase so that the melody harmonizer can provide a correct succession of keys of the melody. Even in the worst case when an abrupt modulation occurs within a phrase, the melody harmonizer of the invention can make smaller a portion of melody for which a wrong key is determined.

Another object of the invention is to provide a melody harmonizer capable of making a real and natural chord progression for a given melody. Unlike the prior art, the present melody harmonizer harmonizes a melody by assigning chord patterns rather than chords.

An aspect of the invention provides a melody harmonizer which comprises (A) melody providing means for providing a melody, (B) segmentation means for segmenting a melody into phrases, (C) chord progression database means for storing a chord progression database, and (D) chord progression assigning means for searching through the chord progression database thereby to assign an appropriate chord progression to each of the phrases.

In this arrangement, the segmentation means segments a melody into phrases as self-organized units of the melody. The chord progression database means stores a chord progression (chord pattern) database. The chord progression assigning means searches through the chord progression database for a chord progression appropriate for each of the phrases for assignment. Thus, the melody harmonizer can make a real and natural chord progression for the melody.

A further object of the invention is to provide a melody analyzer capable of analyzing a melody for its style.

An aspect of the invention provides a melody analyzer which comprises melody providing means for providing a melody, style designating means for designating a music style, phrase database means for storing a database of phrases grouped by music styles, and phrase finding means for finding a portion of the melody which matches a phrase in a phrase group of the designated music style in the phrase database means.

This arrangement enables analyzing a melody for a desired music style. The melody analyzer can extract, from a melody, a portion having the desired music style, a style-matched phrase. An automatic music arranger utilizing the present melody analyzer can easily provide a music arrangement with a flavor of the desired music style.

A further object of the invention is to provide a melody harmonizer which utilizes a melody analyzer of the invention thereby to make a chord progression with a style matching that of a melody to be harmonized by the chord progression.

An aspect of the invention provides a melody harmonizer which comprises melody providing means for providing a melody, style designating means for designating a music style, phrase database means for storing a database of phrases grouped by music styles, chord progression database means for storing a database of chord progressions grouped by music styles, phrase finding means for finding a portion of the melody which matches a phrase in a phrase group of the designated music style in the phrase database means, and chord progression searching means for searching a chord progression group of the designated music style in the chord progression database means thereby to make a chord progression for the portion of the melody.

With this arrangement, the melody harmonizer can assign a chord progression of the desired music style to a melody portion of the same music style so that the resultant chord progression conforms to the melody in terms of music style.

BRIEF DESCRIPTION OF THE DRAWINGS

The above and other objects, features and advantages of the invention will become more apparent from the following description taken in conjunction with the accompanying drawings in which:

FIG. 9 shows a coupling data memory;

DETAILED DESCRIPTION OF THE PREFERRED EMBODIMENTS

Figure 1:
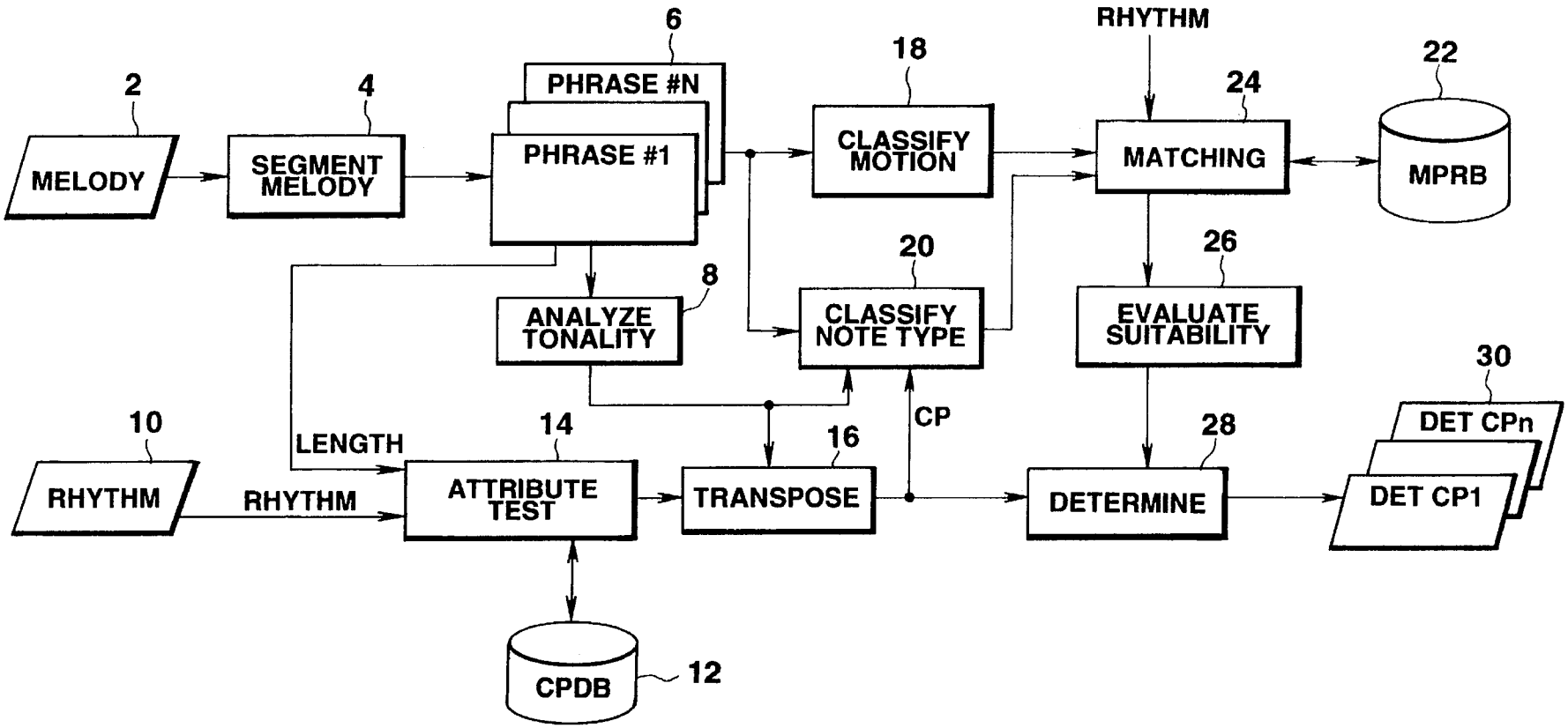
FIG. 1 is a functional block diagram of an apparatus for analyzing and harmonizing a melody in accordance with the invention.

Referring first to FIG. 1, there is shown a functional block diagram of a melody harmonizer having melody analyzing capability in accordance with a first embodiment of the invention. A reference numeral 2 denotes a given melody. A melody segmentation module 4 segments the melody 2 into a plurality of melody segments or phrases as shown by phrases No. 1 to No. n designated by reference numeral 6. A tonality analyzing module 8 determines tonality or key of each phrase.

Elements 4 to 8 define a melody analyzer. The overall arrangement of FIG. 1 functions to harmonize a given melody with a chord progression.

In accordance with the first embodiment of the invention, the apparatus does not assign chords to respective portions of the melody on a chord-by-chord basis, but collectively determines chord sequences or progressions to respective phrases on a phrase-by-phrase basis. To this end, there is provided a chord progression database (CPDB) memory 12. CPDB 12 stores a database of chord progressions of various music styles. A reference numeral 10 indicates a designated music or rhythm style. An attribute test module 14 retrieves from CPDB 12 a chord progression meeting the requirement of the designated rhythm style and the length of a phrase to be harmonized by the chord progression. Each chord progression record stored in CPDB 12 is written in a reference key so that a transposing module 16 transposes the retrieved chord progression according to the key of the phrase from the tonality analyzing module 8.

A motion classifying module 18 and a note type classifying module 20 define a note interpreter for interpreting the meaning of each note in a phrase or melody segment. Specifically, the motion classifying module 18 classifies a motion between notes according to a pitch difference (interval) between the notes. The note type classifying module 20 receives a phrase key from the tonality analyzing module and a retrieved chord progresssion (i.e., chord progresssion candidate of a phrase) and uses them to classify each note in the phrase.

A melody pattern rule base (MPRB) memory 22 stores a rule base of melody patterns available in respective music styles. A matching module 24 receives note classification data of each note from the motion classifying module 18 and note type classifying module 20 and tests the note classification data to see whether it meets a melody pattern of the designated style 10. To this end, the matching module 24 retrieves from MPRB 22 a melody pattern of the designated rhythm style 10 and matches it against the note classification data. Those notes in the phrase which have matched a melody pattern are labeled with "pattern matched."

The operation of the note type classifying module 20 depends on a retrieved chord progression. Thus, if the retrieved chord progression is not suitable for a phrase, the matching module 24 will yield a relatively large number of phrase notes mismatching a melody pattern rule. In other words, a proportion of phrase notes having a pattern-matched label is a measure of suitability of a retrieved chord progression for the phrase. The classification results from the note type classifying module 20 also depend on a phrase key determined by the tonality analyzing module 8. If the tonality analyzing module provides a wrong phrase key, this will decrease the proportion of phrase notes labeled with pattern-matched.

It is, therefore, preferred that the tonality analyzing module 8 provide a plurality of keys as key candidates of a phrase in consideration of all key possibilities of the phrase.

A suitability evaluating module 26 receives results from the matching module 24 to evaluate suitability of a chord progression by computing the proportion of phrase notes labeled with pattern-matched.

A determining module 28 selects from among retrieved chord progressions a chord progression with the highest suitability, as a determined chord progression for a phrase. A reference numeral 30 denotes determined chord progressions in which DET CP 1 indicates a chord progression for a first phrase and DET CPn indicates a chord progression determined for an n-th phrase.

As understood from the foregoing, the melody segmentation module 4 in combination with the phrase tonality analyzing module 8 makes it possible to detect modulation in a melody.

Assigning a chord progression (i.e., musically organized succession of chords) from CPDB 12 to each phrase obtained by segmenting a melody enables melody harmonization unattainable by the prior art which assigns chords to a melody on a chord-by-chord basis.

Figure 2:
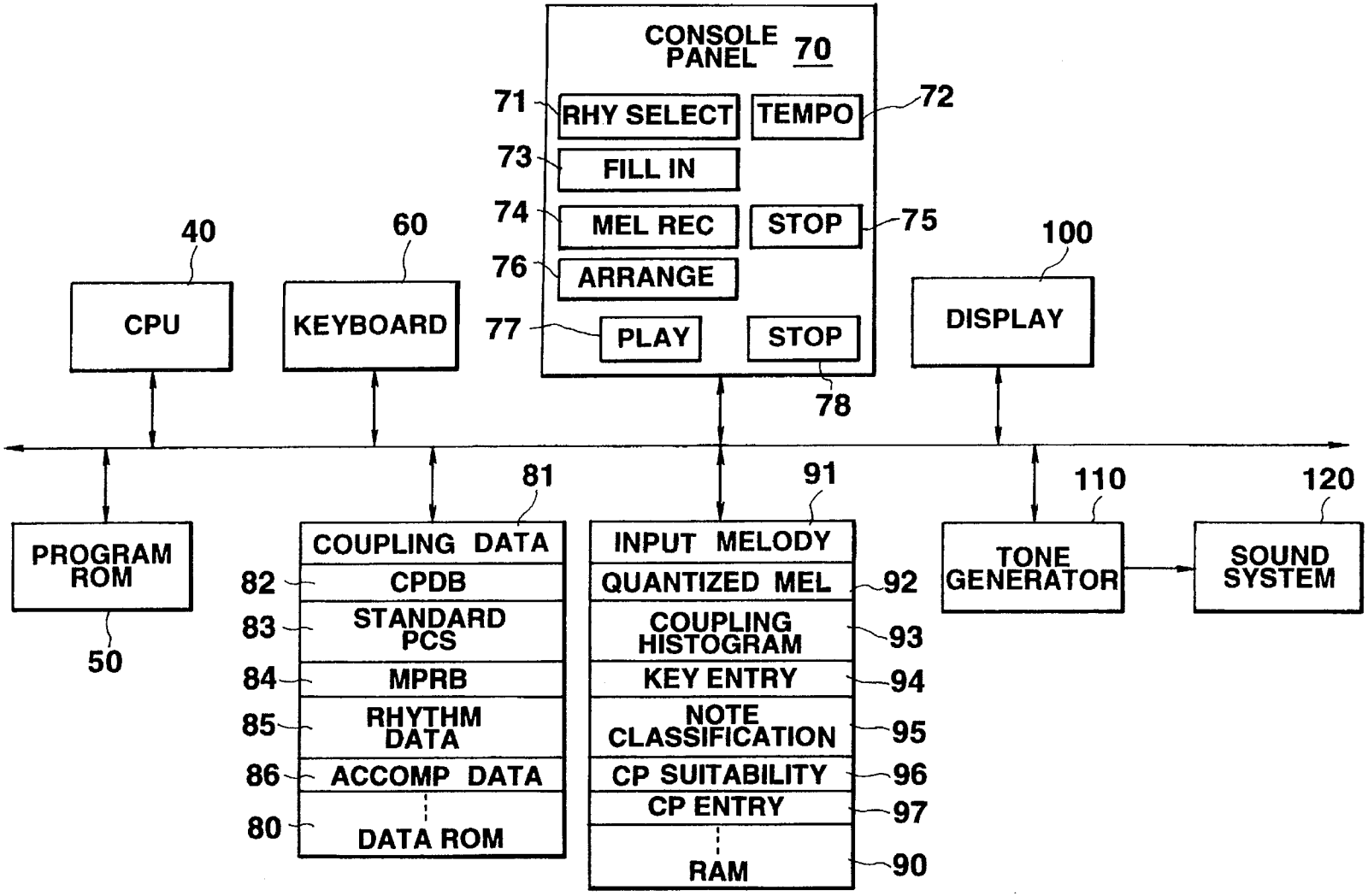
FIG. 2 is a block diagram showing a hardware organization of a music apparatus in accordance with an embodiment of the invention.

FIG. 2 shows a block diagram of a hardware organization of a music apparatus (configured here as an electronic keyboard instrument) in accordance with the embodiment of the invention.

CPU 40 operates according to a program stored in a program ROM 50 to control the entire system. A keyboard 60 may be identical with a musical keyboard of a conventional electronic keyboard instrument and is used for music performance. A console panel 70 comprises a rhythm select key 71 for designating a rhythm or accompaniment style, a tempo volume 72 for designating a performance speed of music, a fill-in key 73 for directing points where a melody is segmented, a melody record key 74 for requesting recording of a melody played by the keyboard 60, a stop key 75 for stopping the melody recording, an arrange key 76 for requesting the apparatus to arrange (harmonize with accompaniment) the recorded melody, a play key 77 for causing automatic play of the arranged music, a stop key 78 for stopping the play of the arranged music, and other keys and switches required for the operation of the music apparatus.

A data ROM 80 stores permanent data and includes a note coupling coefficient memory 81 used in tonality analysis, a chord progression database (CPDB) memory 82, a standard pitch class set (PCS) memory 83 for storing each standard PCS of chord and tension notes, a melody pattern rule base (MPRB) memory 84, a rhythm data memory 85 for storing rhythm patterns of various styles, and an accompaniment data memory 86 for storing accompaniment patterns of various styles.

A RAM 90 includes an input melody memory 91 for storing an input melody i.e., the one played by the keyboard 60, a quantized melody memory 92 for storing a quantized melody obtained by rhythm-quantizing the input melody, a coupling histogram memory 93 for storing a coupling histogram of notes in a phrase (melody segment), a key entry table memory 94 for storing key candidates of each phrase, note classification memory 95 for storing classification data of phrase notes, a CP suitability memory 96 for storing suitability of a chord progression, and a CP entry table memory 97 for storing a chord progression candidate of each phrase.

A display device 100 includes LED display elements and an LCD display panel arranged over the console panel 70. A tone generator 110 generates a tone signal under the control of CPU 40.

A sound system 120 includes amplifiers and loud-speakers for reproducing a sound.

Figure 3:
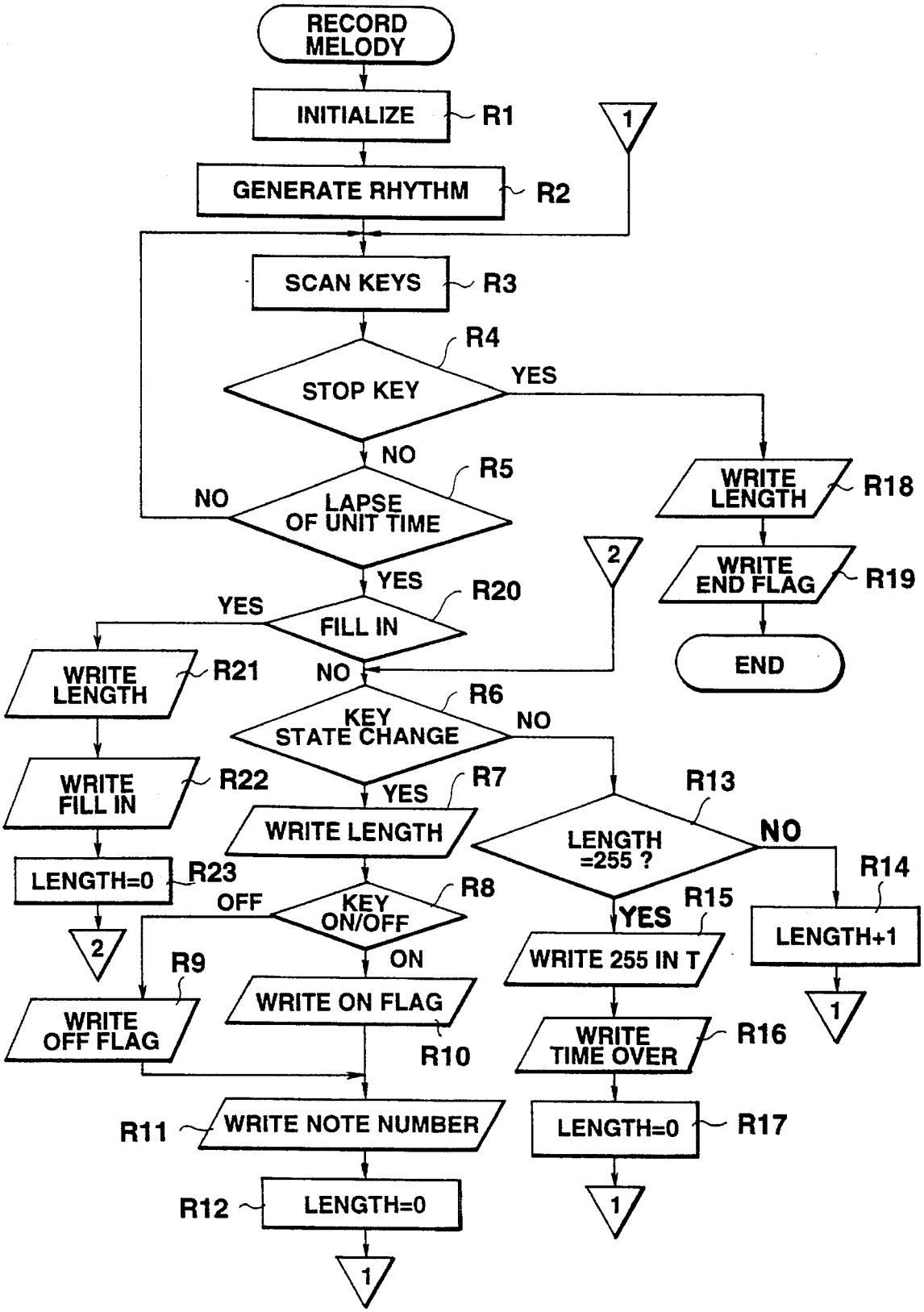
FIG. 3 is a flow chart for recording a melody in real time.
Figure 4:
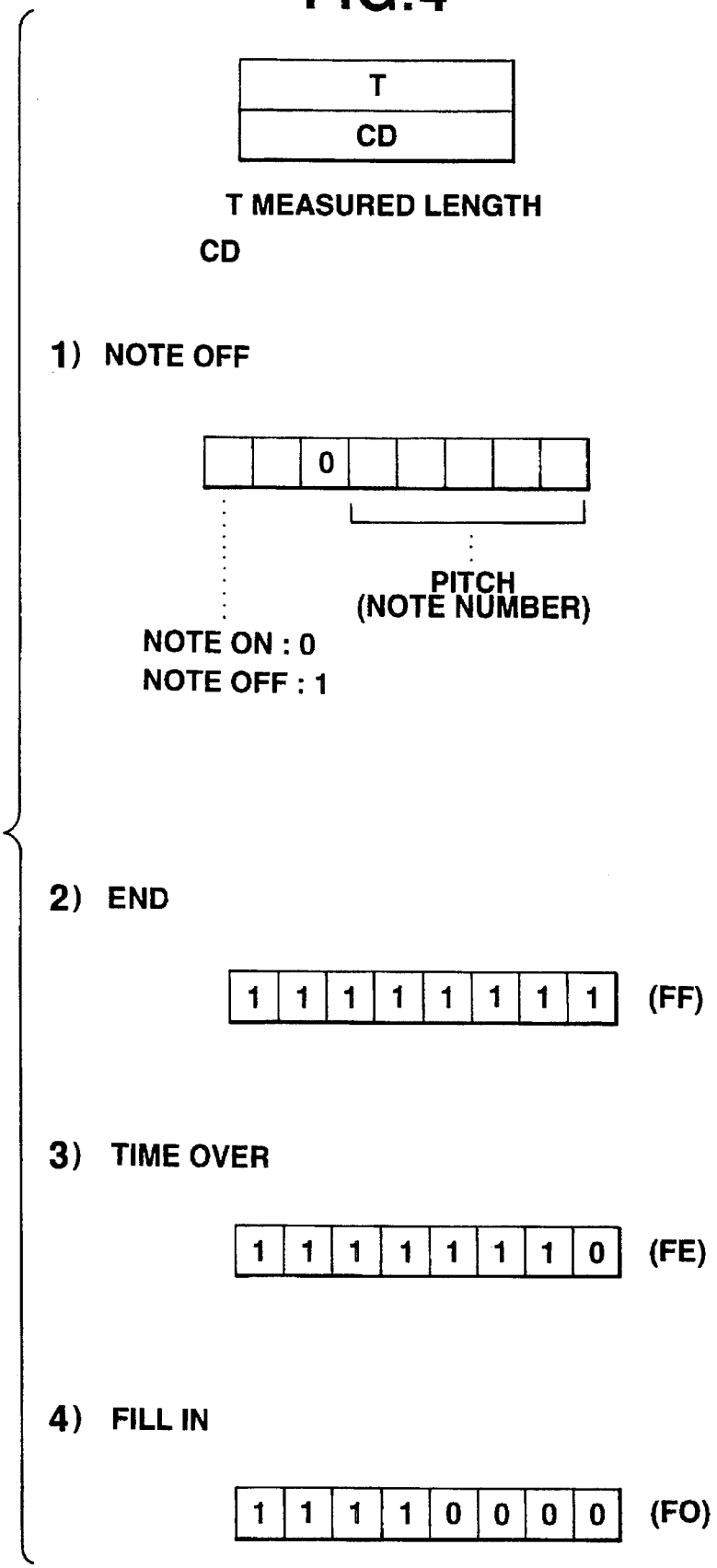
FIG. 4 shows formats of input melody data to be recorded.

FIG. 3 shows a melody recording routine in a flow chart. According to this routine, CPU 40 records a melody played in real time by the keyboard 60 into the input melody memory 91 in RAM 90. FIG. 4 shows a record format of melody data. As shown, each melody data word comprises two bytes having a time byte T and a command byte CD. The time byte T indicates a time difference between events. The command byte CD describes an event. There are five types of events. A note-on event is defined by pressing a key on the keyboard 60. Releasing a key on the keyboard 60 is recognized as a note-off event. A fill-in event is defined by pressing the fill-in key, causing CD=FO. A time-over event (CD=FE) occurs when a predetermined time (LENGTH=255) has elapsed without any other event. Pressing the stop key 75 signals an end event, causing CD=FF. For note-on or note-off event, the lowest five bits of the event byte CD indicates a note number or pitch, bit 6 is set to "0", and MSB is set to "0" for note-on event, and to "1" for note-off event.

The fill-in key 73 is used to direct a point where a melody is segmented. During the automatic play of a arranged music, the same key 73 is used to request playing a fill-in performance.

In response to the operation of the melody record key 74, CPU 40 calls and executes the melody recording routine of FIG. 3. Initialization step R1 allocates the area of the input melody memory 91 in RAM 90 and clears a length counter LENGTH. Step R2 starts rhythm. As a result, a rhythm of the designated style is played by means of the rhythm pattern data memory 84 and the tone generator 110. A user plays a melody while listening to the rhythm.

Key scanning step R3 reads states of the keyboard 60, fill-in key 73 and stop key 75. Each time when a unit of time defining music resolution depending on tempo has passed, step R20 checks to see whether the fill-in key 73 has been pressed. In the affirmative, steps R21 to R23 execute writing of fill-in data by writing LENGTH into time byte T, writing a fill-in flag into command byte CD and clearing the counter LENGTH.

In the negative, step R6 checks to see whether the state of the keyboard 60 has changed due to either note-on (key-on) or note-off (key-off) event. In the affirmative, step R7 writes LENGTH into time byte T. Then step R8 checks if the event is a note-on or note-off. For a note-on event, step R10 writes a note-on flag into command byte CP, whereas in the case of a note-off event, step R9 writes a note-off flag into command byte CD. Then step R11 writes a note number of the note-on or off event. Step R12 clears the counter LENGTH. The recording routine returns to the key scanning step R3 which is the entry to the loop of R3 to R5 for waiting for the lapse of a unit of time.

In the case when the keyboard state has not changed, step R13 checks if the counter LENGTH has reached 255 (FF). If not, the routine increments the counter LENGTH (R14) before returning to the key scanning step R3. In the affirmative, the recording routine writes 255 into time byte T (R15), writes a time-over flag into command byte CD (R16), clears the counter LENGTH (R17), and returns to the key scanning step R3.

Having finished melody performance, the player presses the stop key 75. This is detected at step R4. Then the melody recording routine writes LENGTH into time byte T (R18), writes an end flag into command byte CD (R19), thus finishing the melody recording process.

In this manner, a melody played by the keyboard 60 has been recorded into the input melody memory 91.

Thereafter, when the arrange key 76 is operated, an arrange process for arranging the recorded (input) melody is carried out.

A preprocess to the arrange process quantizes the input melody with the results (quantized melody data) stored into the quantized melody memory 92.

Figure 5:
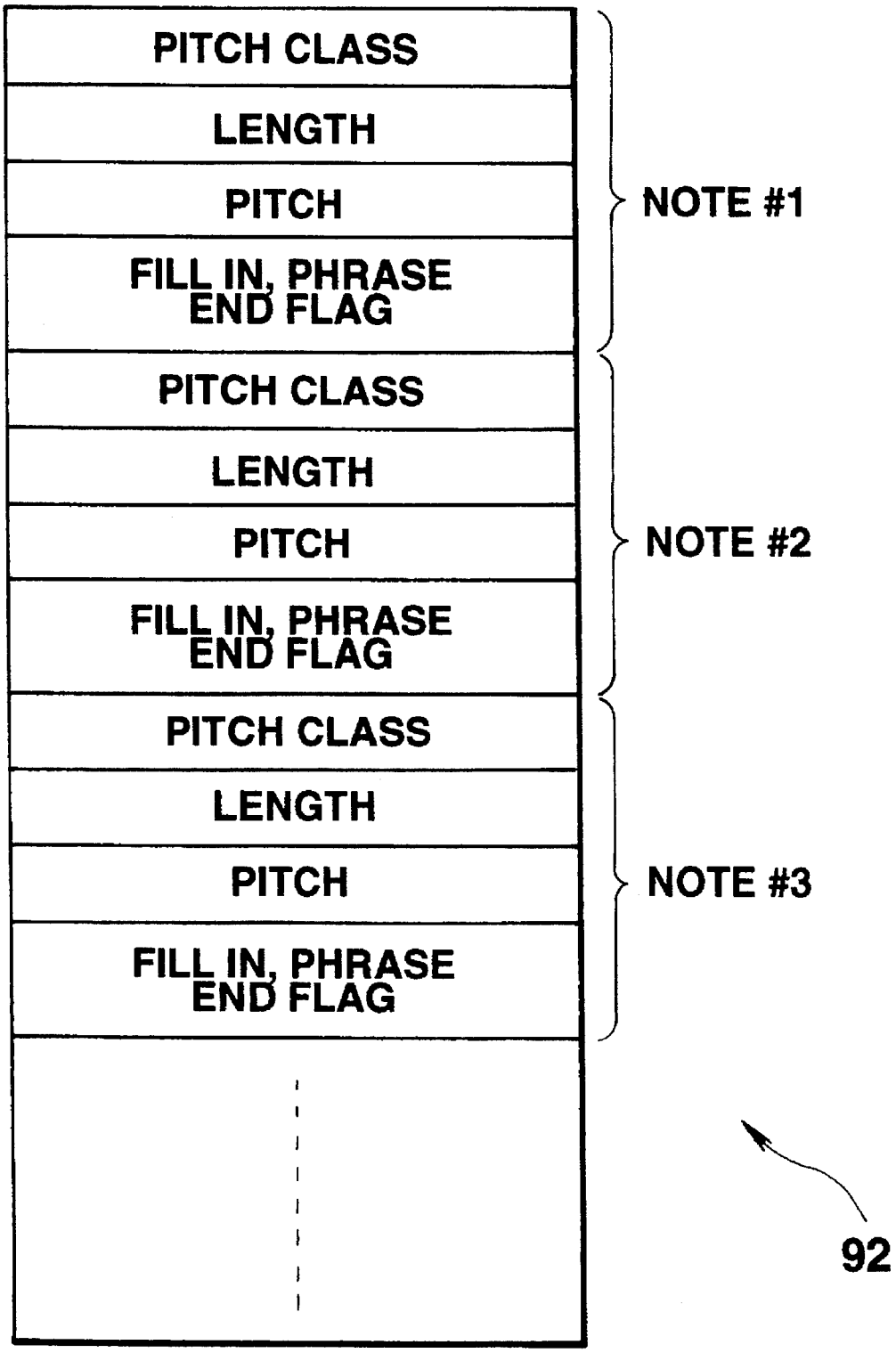
FIG. 5 shows a format of quantized melody data.

FIG. 5 shows the data format of the quantized melody memory 92. In the memory 92, a record of a musical note comprises four bytes of a pitch class byte, a length byte, a pitch byte, and a flag byte. The pitch class byte normally indicates a note pitch class. Hexadecimals 00 to 0B denote pitch classes C to B, respectively. A pitch class byte of "0F" denotes a rest. A pitch class byte of "0E" indicates a tie. The length byte indicates a (quantized) note length. The pitch byte indicates a note pitch. The flag byte is used as a flag for indicating either a fill-in or end of a phrase. The flag byte is set to "80" for the fill-in only, "01" for the fill-phrase end only, "81" for the fill-in and the phrase end, and "80" without fill-in or phrase end.

At the completion of the melody quantization, the quantized melody memory 92 has stored all information except for the phrase end flag information. Writing phrase end flags is carried out in a segment melody routine to be described. An area from one phrase end to the next defines a melody segment or phrase.

After the melody quantization, the apparatus determines tonality of the entire melody.

Figure 6:
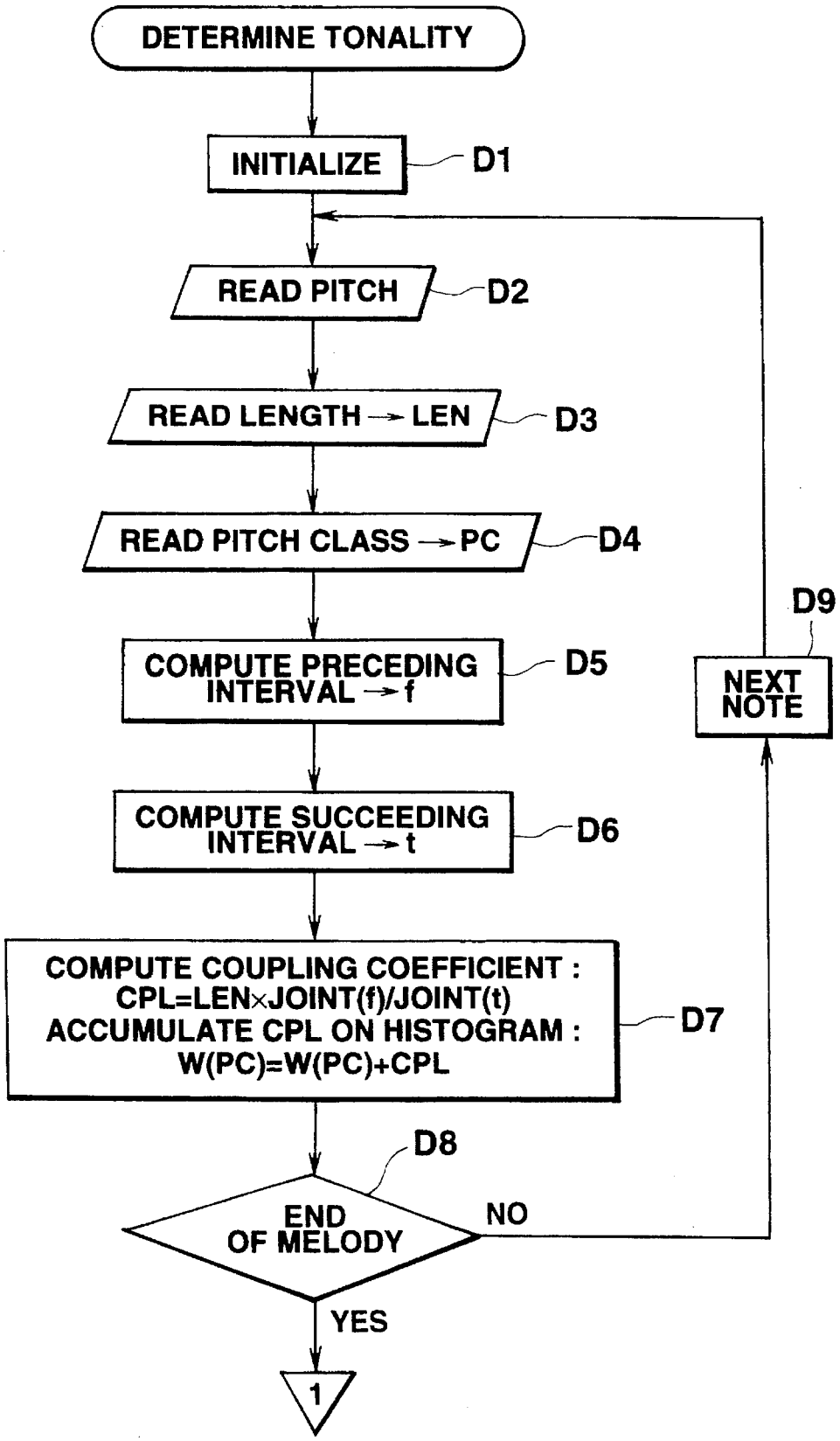
FIGS. 6 to 8 are flow charts for determining tonality.
Figure 7:
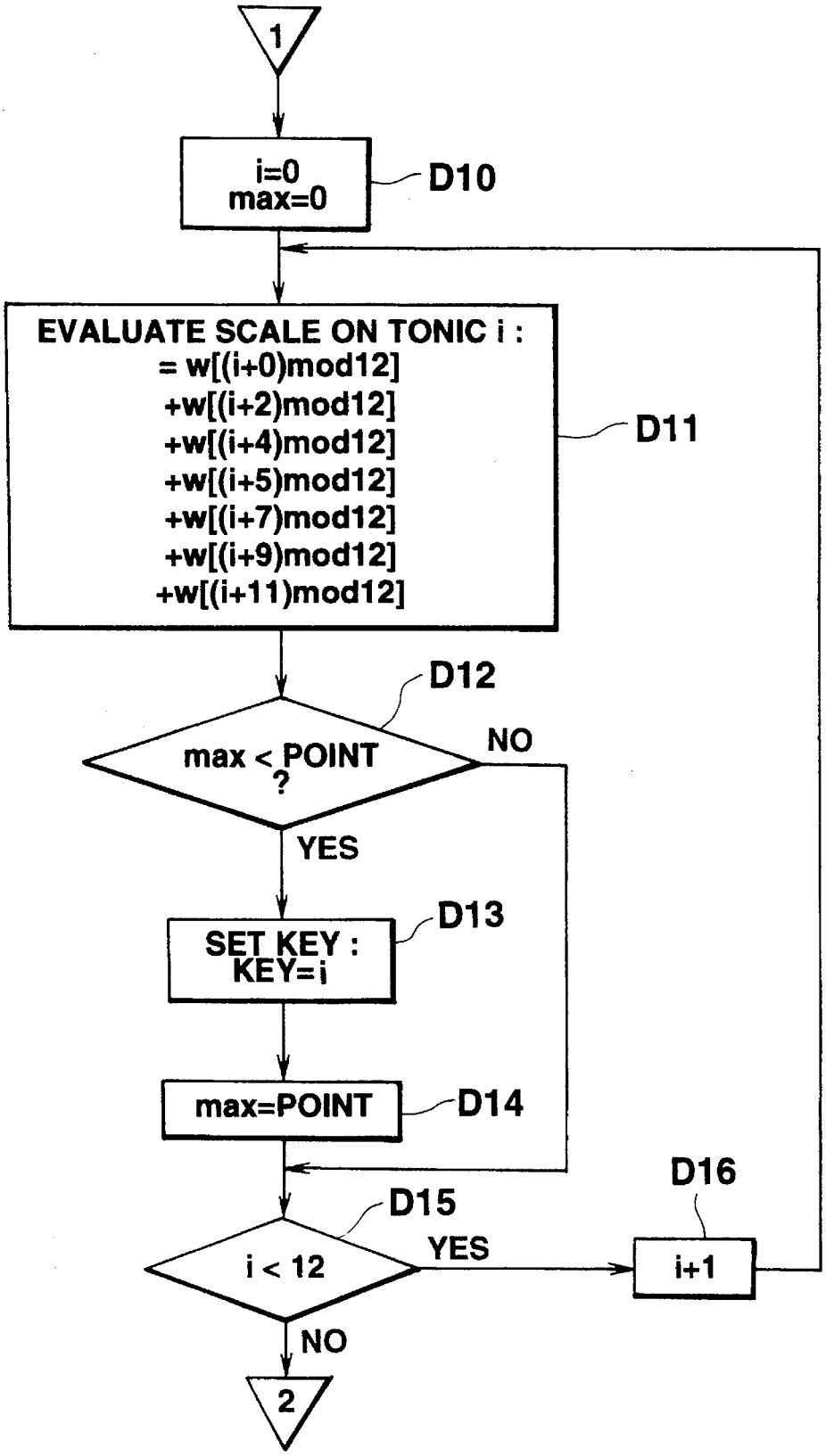
Figure 8:
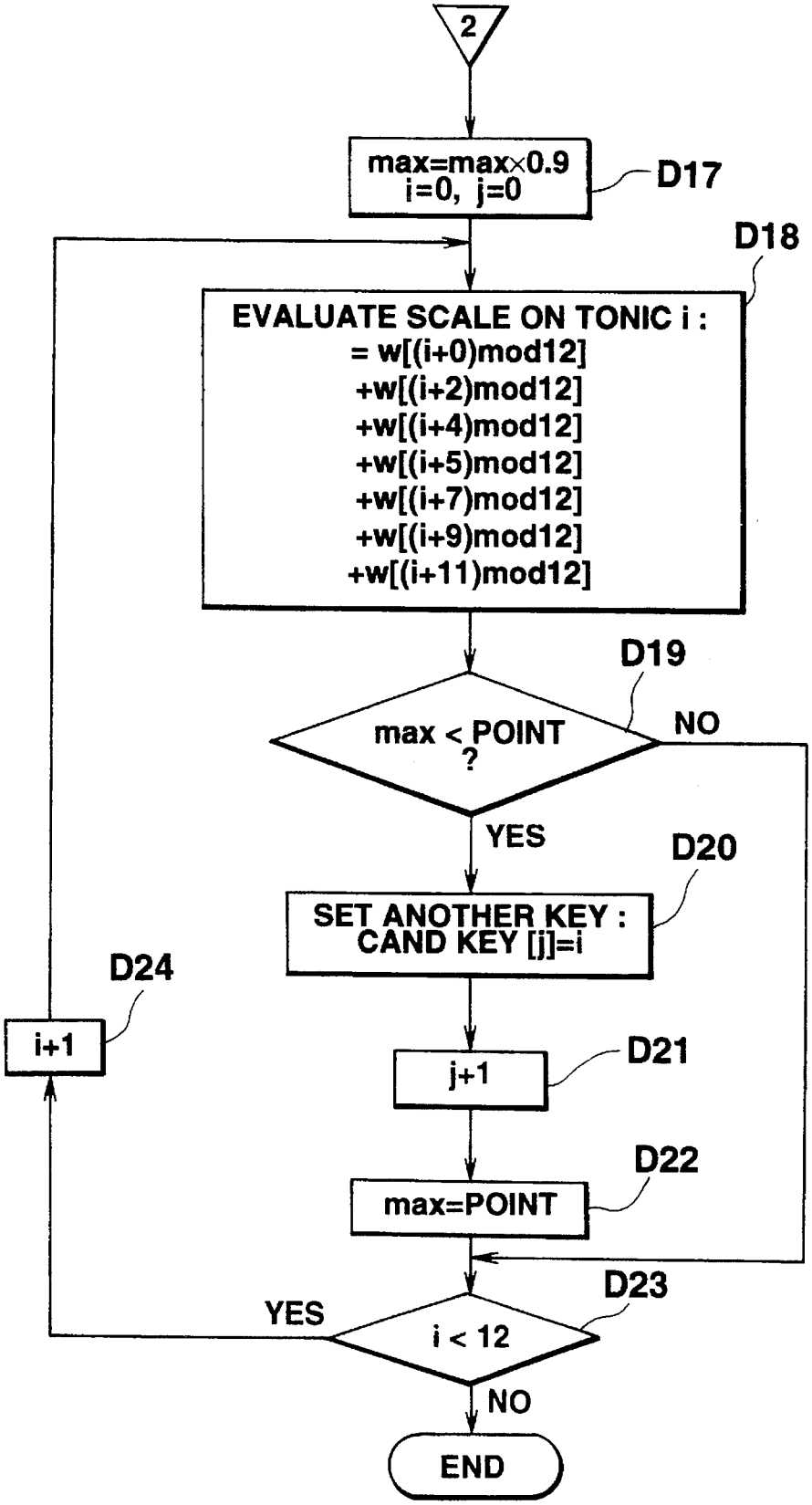

FIGS. 6 to 8 show flow charts of the determine tonality routine. This routine analyzes, for each note, a motion formed by the note and its adjacent notes and generates a plurality of key candidates of the melody based on the analysis. The coupling data memory 81 such as shown in FIG. 9 is used in the motion analysis. The coupling data memory 81 stores a note coupling coefficient between two adjacent notes as a function of the pitch difference (interval) formed therebetween.

Initialization step D1 of the determine tonality routine locates start (first note record) of the quantized melody and clears the key entry 94. Step D2 reads the current and its preceding and succeeding note pitches. Step D3 reads current note length LEN. Step D4 reads current note pitch class PC. Step D5 computes a first pitch difference f (preceding interval) of the current note from the preceding note. Step D6 computes a second pitch difference t (succeeding interval) of the current note to the succeeding note. Step D7 looks up the coupling data memory 81 by the preceding and succeeding intervals f and t, thus obtaining a preceding coupling coefficient JOINT (f) and a succeeding coupling coefficient 1/JOINT (t). Then, using these coupling coefficients and the current note length LEN, step D7 computes the coupling coefficient of the current note, CPL by $$CPL = LEN \times JOINT(f)/JOINT(t)$$

Then step D7 adds CPL to an element W(PC) of the coupling histogram corresponding to the current note pitch class.

The above process repeats for every note of the melody (D8, D9).

As a result, the coupling histogram has stored an accumulated coupling coefficient of each pitch class of the melody.

Then, the determine tonality routine determines a first candidate for the key of the melody.

Specifically, step D10 initializes a tonic or keynote pitch class counter i to "0" or C pitch class and a register max to "0." Using the coupling histogram, step D11 evaluates a diatonic scale built on a tonic of pitch class i by computing point as $$\begin{aligned} point = {} & W[(i+0)\bmod 12] + \\ & W[(i+2)\bmod 12] + \\ & W[(i+4)\bmod 12] + \end{aligned}$$

-continued $$\begin{aligned} & W[(i+5)\bmod 12] + \\ & W[(i+7)\bmod 12] + \\ & W[(i+9)\bmod 12] + \\ & W[(i+11)\bmod 12] \end{aligned}$$

The scale point evaluation repeats for all possible pitch classes of the tonic (D15, D16).

The routine stores the tonic pitch class that has yielded the maximum point as a first candidate for the key of the melody into the key entry 94 (D12, D13) and also stores the maximum point max (D14).

The determine tonality routine further stores those tonic pitch classes that have yielded the point greater than 90 percent of the maximum point as second, third, and so on key candidates cand key [j] into the key entry 94.

The results of the melody tonality determining process are utilized in a phrase tonality determining process for determining the key of the first and last phrases.

Since it is a preprocess to the phrase tonality determining process, the process of determining the entire melody tonality may be omitted if desired.

Having determined the melody tonality, the apparatus segments the melody into phrases.

Figure 10:
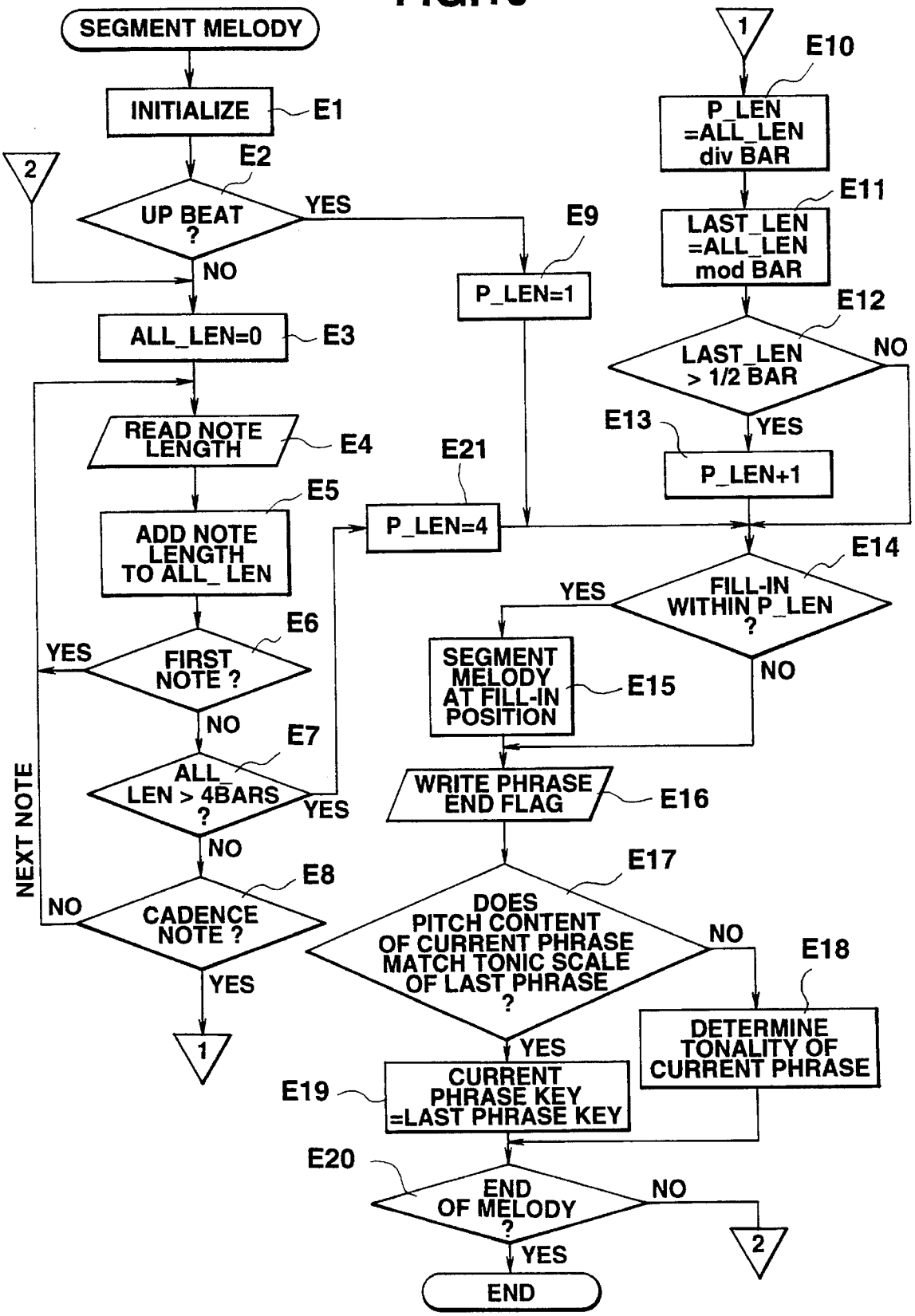
FIG. 10 is a flow chart for segmenting a melody.

FIG. 10 shows a flow chart of the segment melody routine. This routine has the following functions.

(A) checking if the melody starts with an upbeat or auftakt, (B) detecting a four-bar melody segment as a phrase, (C) detecting from the melody, a phrase-ending or cadence note, and (D) interpreting a fill-in flag as a melody segmenting point.

Figure 11:
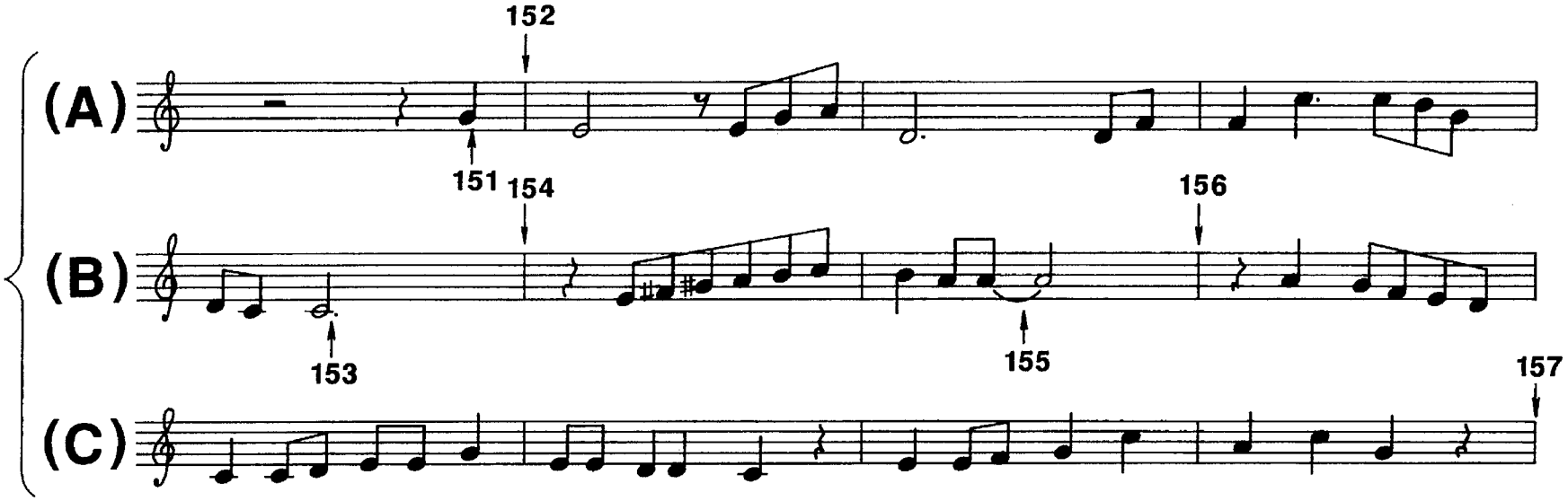
FIG. 11 shows staves illustrating how a melody is segmented.

For example, in the staff (A) of FIG. 11, a G note 151 is detected as an upbeat note so that the bar line 152 succeeding the note 151 is interpreted as a segmenting point between the first and second phrases. In the staff (B) of FIG. 11, a C note 153 and an A note 155 are each recognized as a cadence note so that the bar line 154 succeeding the cadence note 153 is interpreted as a segmenting point between the first and second phrases whereas the bar line 156 succeeding the cadence note 155 is interpreted as a segmenting point between the second and third phrases. In other words, the first bar forms the first phrase, the second and third bars form the second phrase, and the third phrase begins with the fourth bar. For the staff (C), the segment melody routine detects a four-bar melody and interprets the bar line 157 as a segmenting point between the first and second phrases.

Specifically, the segment melody routine locates the start of the quantized melody at initialization step E1. Step E2 checks if the melody starts with an upbeat by testing the length of an initial rest (if any) to see whether it is longer than half a bar. In the affirmative, the routine recognizes the first bar as the first segment or phrase of the melody (E9).

Step E3 initializes phrase length counter ALL-LEN to "0." Entry step E4 of the loop E4 to E8 reads a current note length. Step E5 adds the note length to ALL-LEN. If the current note is not the first (E6) and if ALL-LEN has exceeded four-bar length (E7), step 21 sets P-LEN to 4, thus indicating a four-bar phrase. Step E8 checks if the current note is a cadence note. To this end, step E8 tests the length of the current note (which length includes the length of a rest if the rest comes after the current note) to see whether it is longer than ¾ of a bar. Having detected a cadence note, the segment melody routine determines a segmenting point (E10 to E13). Specifically, if the cadence note ends at a position LAST-LEN before the center point of a bar, phrase length P-LEN is set such that a segmenting point is defined by the end of the bar (E10, E13). Otherwise, phrase length P-LEN is set such the end of a bar preceding the bar containing the cadence note defines a segmenting point (E10).

Step E14 tests a melody portion P-LEN to see whether it contains a fill-in flag. In the affirmative, a melody segmenting point is determined according to the position of the fill-in flag (E15). If the fill-in flag is positioned before ¾ of a bar, phrase length P-LEN is set such that the end of a bar immediately preceding the bar containing the fill-in flag defines a melody segmenting point. Otherwise, phrase length P-LEN is set such that the end of the bar containing the fill-in flag defines a melody segmenting point.

In this manner, a melody segmenting point is determined upon detection of a fill-in, cadence note, upbeat or lapse of four bars.

Then step E16 writes a phrase end flag at a location in the quantized melody memory 92 corresponding to the determined melody segmenting point, thus indicating that a phrase ends at that location.

Up to E16, the routine has determined the current phrase. Step E17 tests the pitch contents of the current phrase to see whether they are included in the diatonic scale starting with the tonic (keynote) of the last phrase (or the entire melody in the absence of the last phrase). In the affirmative, step E19 sets the key entry of the current phrase equal to that of the last phrase. In the negative, step E18 determines tonality of the current phrase. This is done by carrying out the process described in conjuntion with FIGS. 6 to 8 with respect to the current phrase rather than the entire melody.

If the melody has not ended (E20), the routine returns to step E3 to continue the melody segmentation and phrase tonality determination with respect to the next phrase.

In this manner, the melody segment routine segments the melody into a plurality of phrases. The quantized melody memory 92 has stored a phrase end flag at the position where each phrase ends while the key entry table memory 94 has stored key candidates of each phrase.

Thereafter, the apparatus performs the melody harmonization.

Figure 12:
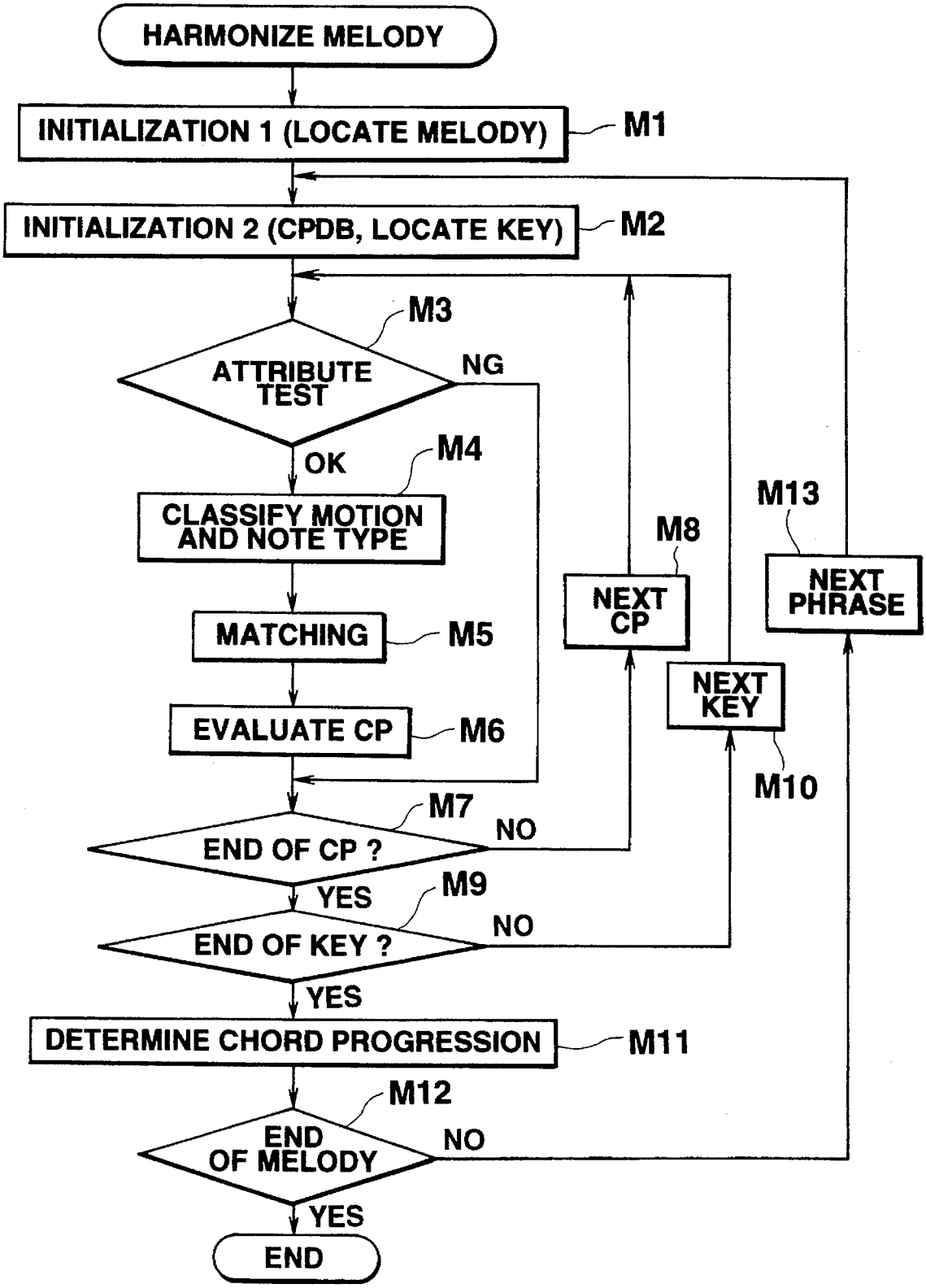
FIG. 12 is a flow chart for harmonizing a melody.

FIG. 12 shows a simplified flow chart of the harmonize melody routine. The purpose of this routine is to assign a desirable chord progression to each phrase.

Initialization step M1 locates the first phrase of the melody that has been segmented into phrases. Step M2 locates the first chord progression in CPDB 82 and reads a first key candidate of the first phrase from the key entry table memory 94.

Step M3 tests attributes (rhythm style and length) of a chord progression retrieved from CPDB 82. If the chord progression fails the attribute test, the harmonize melody routine locates the next chord progression in CPDB 82 (M8) and returns to the test step M3. If the chord progression passes the attribute test, the routine goes to step M4 of classifying motion and type.

The step M4 classifies a motion and note type of each note in the current phrase based on the current key candidate and the chord progression, thus producing note classification data 95.

Matching step M5 tests the note classification data 95 based on melody pattern rules stored in MPRB 84 to label those phrase notes having a stored melody pattern with pattern matched.

CP evaluating step M6 evaluates suitability of the chord progression by the propotion of phrase notes labeled with pattern matched, and stores into CP entry table 97 the chord progression if it has yielded a relatively high suitability.

If the end of CPDB 82 has not been reached (M7), the routine locates the next chord progression in CPDB 82 (M8) and returns to the attribute test step M3.

The loop of M3 to M8 repeats for all chord progression records in CPDB 82 for a phrase whose key is assumed to be a key candidate from the key entry table 94.

Then, step M9 checks if there remains another key candidate of the current phrase in the key entry table 94. In the affirmative, the routine locates the next key candidate in table 94 (M10) and returns to the loop of M3 to M8.

In this manner, all chord progressions in CPDB 82 are tested for all key candidates of the current phrase.

Step M11 determines a chord progression for the current phrase. This may be done by selecting, from among candidates for a chord progression of the currrent phrase, a candidate having the highest suitability.

In the alternative, chord progression determination or selection may be done each time when play of an arranged music is requested.

Step M12 checks if there still remains another phrase for which a chord progression is to be made. In the affirmative, the routine locates the next phrase (M13) and returns to the step M2.

In this manner, the harmonize melody routine makes and assigns a desirable chord progression to every phrase in the quantized melody memory 92.

Figure 13:
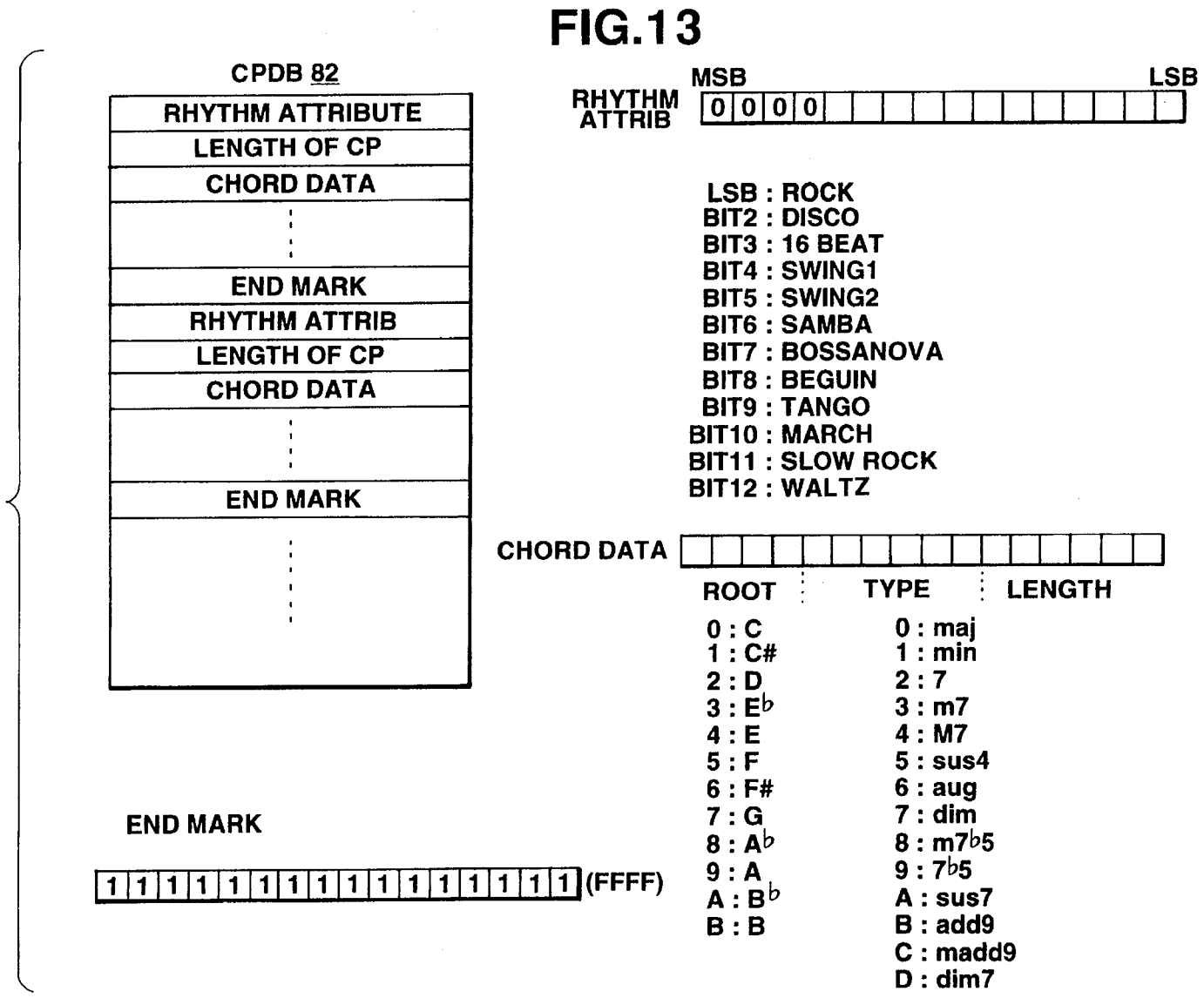
FIG. 13 shows a format of a chord progression database memory.

FIG.13 shows a format of the chord progression database (CPDB) 82. Each chord progression record in CPDB 82 comprises rhythm attribute, length, a succession of chords and an end mark. Each chord in the succession is represented by root, type and length.

Figure 14:
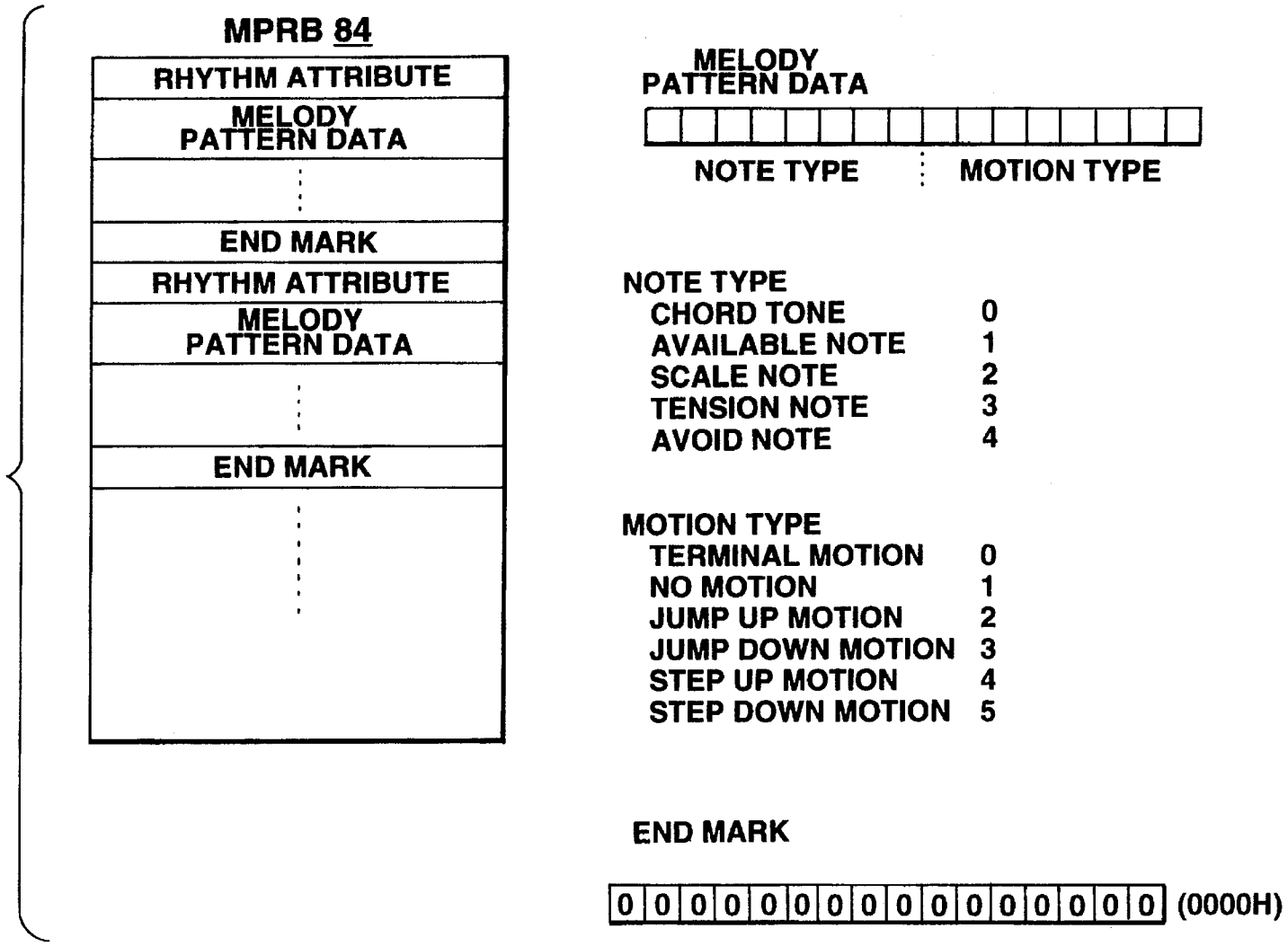
FIG. 14 shows a format of a melody pattern rule base memory.

FIG. 14 shows a format of the melody pattern rule base (MPRB) 84. Each melody pattern record in MPRB 84 comprises a rhythm attribute, melody pattern data indicative of a succession of note functions and an end mark. Each note function is represented by a note type and a motion type.

Figure 15:
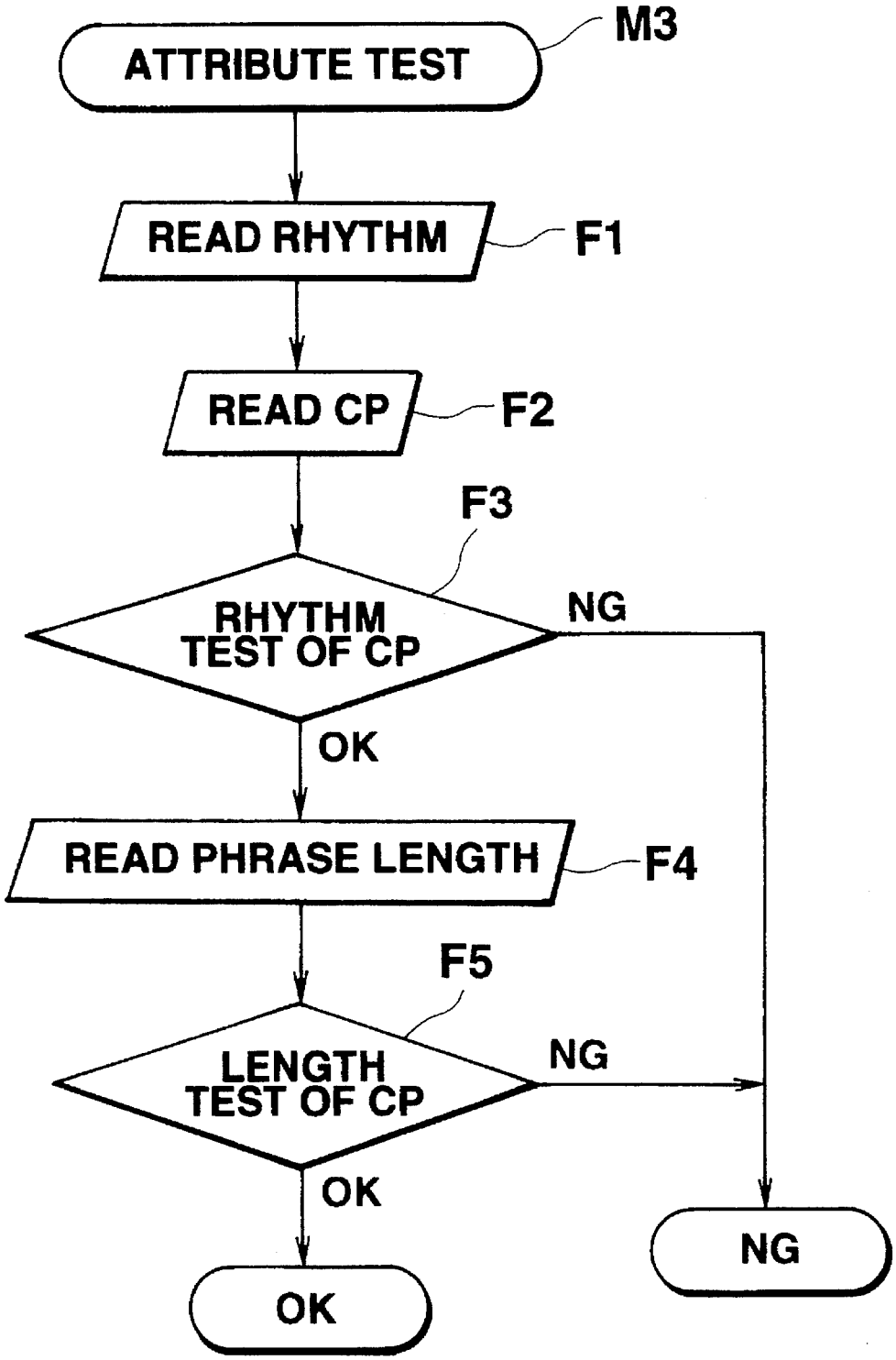
FIG. 15 is a flow chart for attribute test.

FIG. 15 shows a flow chart of the attribute test M3 in FIG. 12. Step F1 reads the designated rhythm style. It is noted that a rhythm of this style was automatically played in the melody recording (FIG. 3) to guide a melody played on the keyboard 60. Step F2 reads a chord progression (CP) from CPDB 82. Step F3 compares the rhythm attribute of the chord progression with the designated rhythm style. If matched, step F4 reads the length of a phrase which is compared with the length of the chord progression (F5). If matched, the attribute test routine M3 returns OK. Otherwise, the routine M3 returns NG.

In this manner, the attribute test routine M3 finds a chord progression in CPDB 82 meeting the phrase length and the designated rhythm style.

Figure 16:
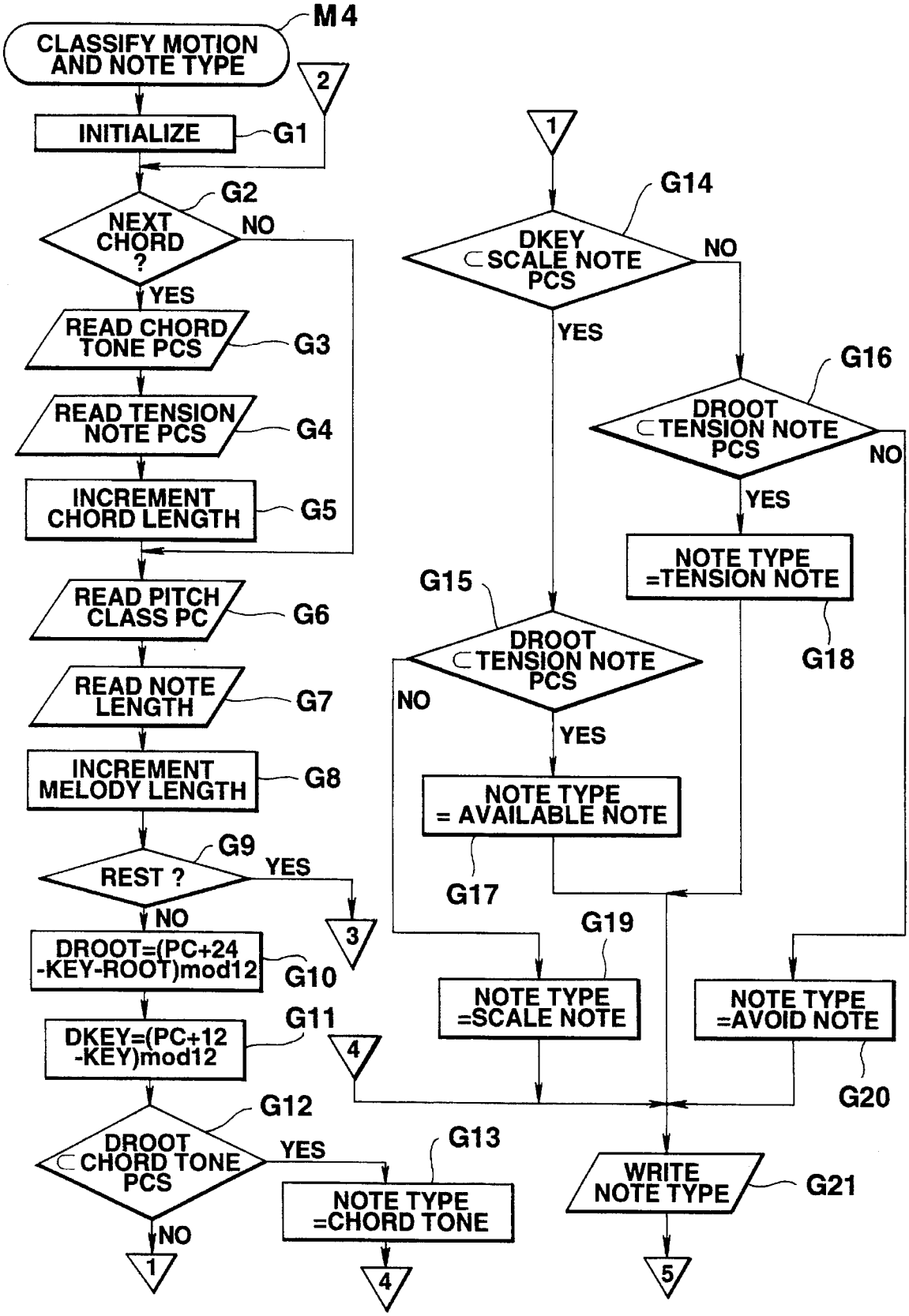
FIGS. 16 and 17 are flow charts for classifying motion and note type.
Figure 17:
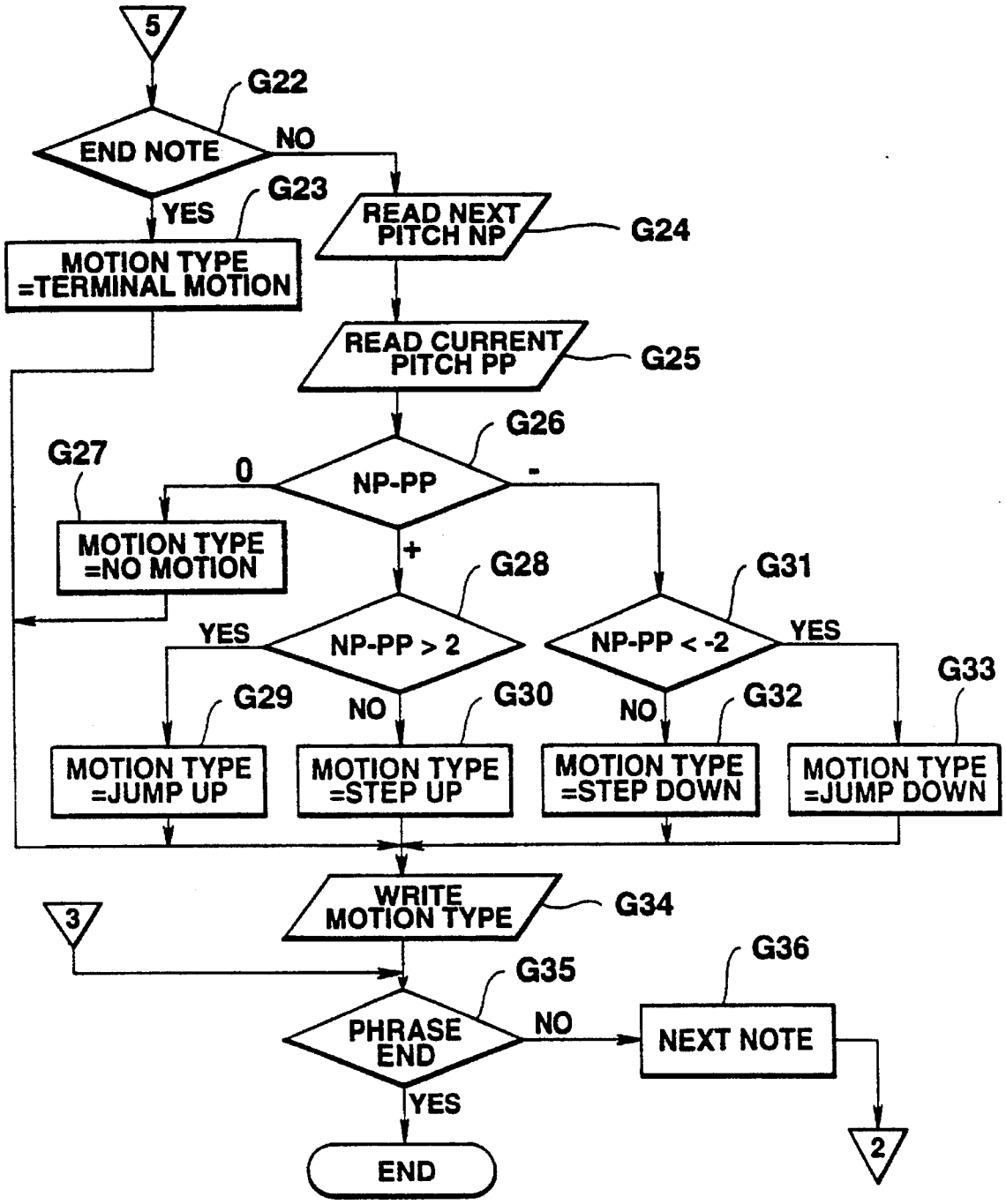

FIGS. 16 and 17 show flow charts of the classify motion and note type routine M4. The purpose of this routine is to classify the note type and motion of each note in a phrase. The classification results are stored into the note classification memory 95. Each note record in the memory 95 comprises three bytes of a note type byte, a motion type byte and a flag byte for pattern matching. Writing of flag bytes is executed later in the matching routine M5. The note type is classified according to musical background of key and chord, and is selected from among chord tone, scale note, tension note, available note and avoid note. The motion type is classified as a function of the pitch change to a succeeding note, and is selected from among terminal motion, no motion, jump up, jump down, step up and step down.

Specifically, the initialization step G1 clears the note classification memory 95, locates the start of the memory 95, the start of the retrieved chord progression and the first note of the current phrase, and clears chord and melody length accumulators.

Step G2 checks if a next chord should be read out from the chord progression, thus determining a chord corresponding in time to a phrase note to be classified. This is done by comparing the chord length accumlator (storing accumulated length of chords from the starting point of the chord progression) with the melody length accumulator (storing accumlated length of phrase notes from the starting point of the phrase). If the accumlated melody length exceeds the accumulated chord length, the routine reads a next chord from the chord progression and uses it to read a chord tone PCS and tension note PCS thereof from the standard PCS memory 83 (G3, G4), and adds the length of the chord to the chord length accumulator (G5) before going to step G6.

Then step G6 reads the current note pitch class (PC). Step G7 reads the current note length. Step G8 adds the length to the melody length accumulator.

Step G9 tests PC to see whether the current note is actually a rest. If this is the case, the routine locates the next note (G35, G36) and returns to step G2 since no classification is required for a rest.

If not a rest, the routine uses (G10, G11) the current note pitch class PC, current chord root ROOT and current key candidate KEY to compute DROOT and DKEY by DROOT=PC+24-KEY−ROOT) mod 12

DKEY=(PC+12-KEY) mod 12

If DROOT is an element of the chord tone PCS (G12), the current note type is classified into chord tone (G13). If DKEY is an element of the scale note PCS i.e., the diatonic scale on C tonic (G14), and if DROOT is an element of the tension note PCS (G15), the current note is classified as the note type of available note (G17). If DKEY is an element of the scale note PCS (G14) but if DROOT is not an element of the tension note (G15), the note type is determined as scale note (G19). If DKEY is not included in the scale note PCS but if DROOT is included in the tension note PCS (G16), the current note is classified as the note type of tension note (G18). If DKEY is not an element of the scale note PCS and if DROOT is not an element of the tension note PCS, the current note type is identified as an avoid note (G20).

The note type thus identified is stored into the note type byte of the current note record in the note classification memory 95 (G21).

So far, the routine has classified the current note type. Next, the routine classifies the motion of the current note.

Specifically, if the current note is the end note of the phrase (G22), the motion type is determined as terminal motion (G23). If not the end note, the routine reads the next note pitch NP (G24) and computes the pitch difference or interval NP−PP in going from the current note to the next (G25). If the interval is "0" indicative of the same pitch, the motion type is identified as no motion (G27). If the interval is "1" or "2" i.e., a pitch increase of a half or whole tone (G28), the motion type is classified as step up (G30). If the interval is greater than "2", the motion type is determined as jump up (G29). If the interval is "−1" or "−2", i.e., a pitch decrease of a half or whole tone (G31), the motion type of the current note is identified as step down (G32). If the interval is less than "−2", the motion type is determined as jump down (G33).

The motion type thus determined is stored into the motion byte of the current note record in the note classification memory 95 (G34).

Step G35 checks if the phrase end has been reached. If not, the routine locates the next note (G36) and returns to step G2 for continuation of the classification process.

In this manner, the note classification memory 95 has stored the classification results of each note in a phrase.

Figure 18:
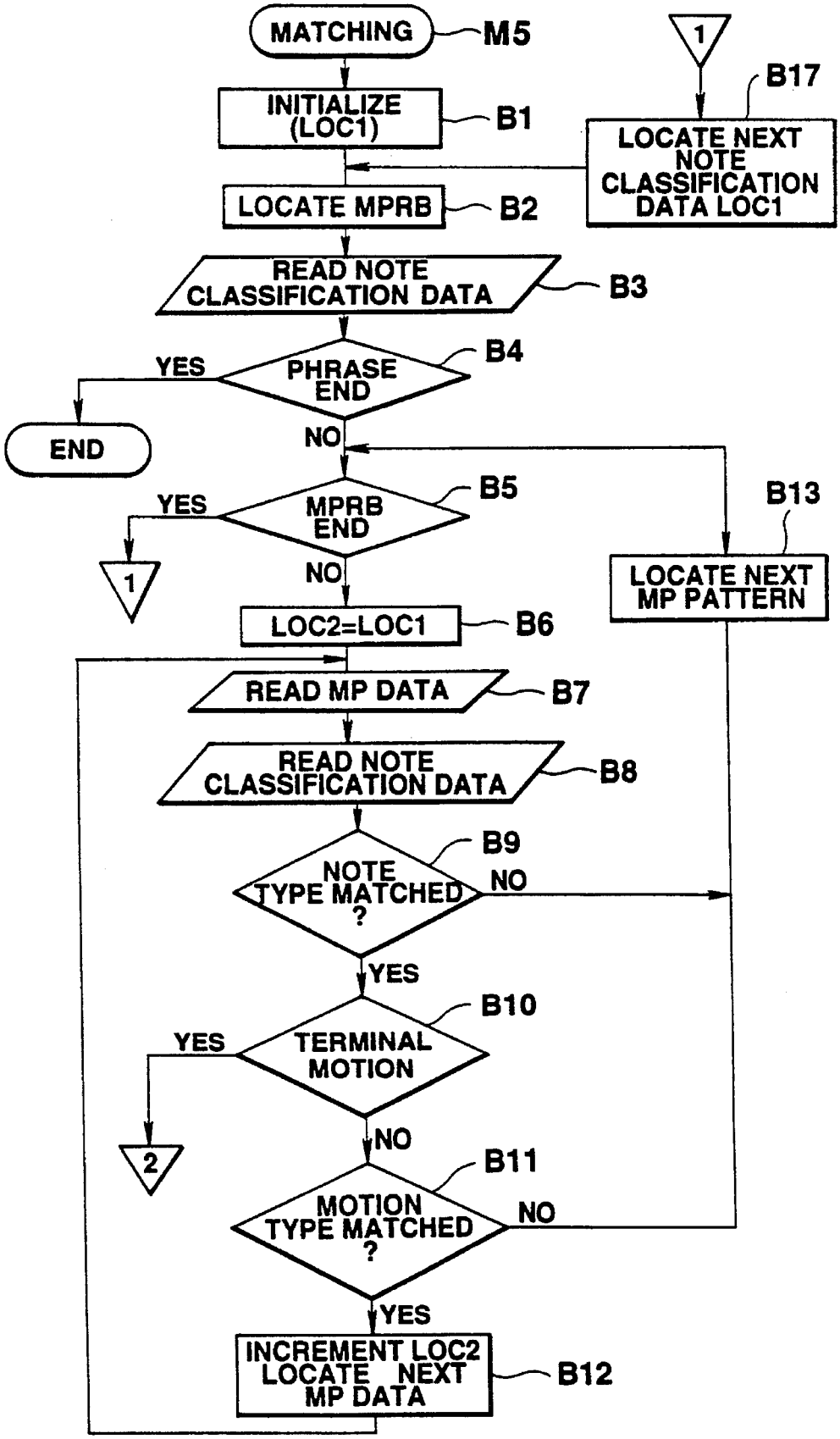
FIGS. 18 and 19 are flow charts for matching a melody against a melody pattern rule base.
Figure 19:
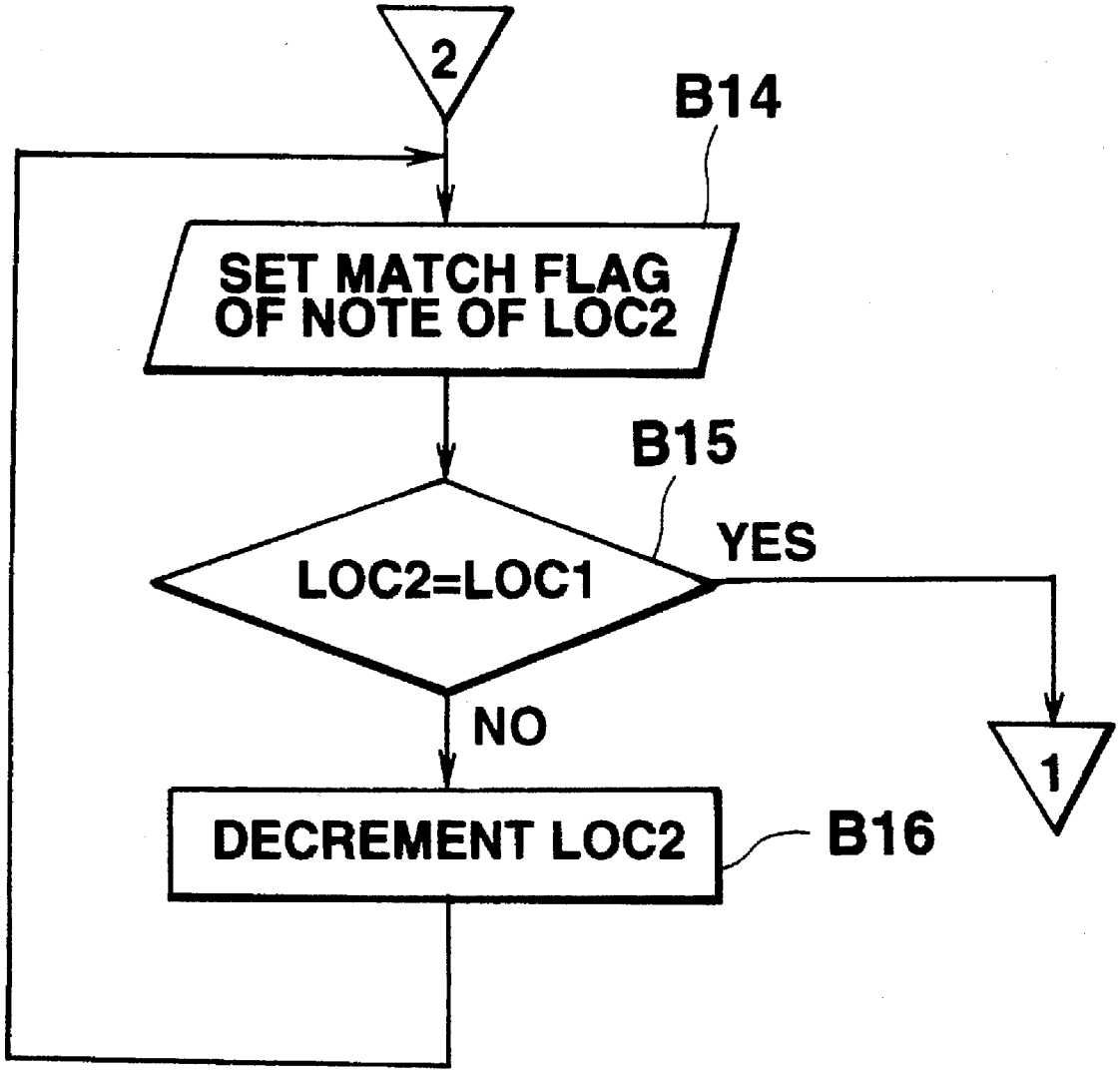

FIGS. 18 and 19 show flow charts of the matching routine M5. This routine matches note classification data in the memory 95, indicative of the analyzed phrase, against melody patterns stored in MPRB 84 and labels with a pattern match flag those phrase notes which have matched a melody pattern.

Specifically, initialization step B1 locates the first note record in the note classification memory 95 by initializing the location LOC 1. Step B2 locates the first melody pattern in MPRB 84 pertaining to the designated rhythm style. Step B3 reads the classification data of the note record pointed to by LOC 1.

If the end of the phrase has not yet been reached (i.e., the data read in step B3 is not an end mark) at B4, and if the end of MPRB 84 has not been reached (B5), step B6 sets a register LOC 2 equal to LOC 1. This means that a matching process starts with the note in the memory 95, pointed to by LOC 1. Thus, the matching process matches a pattern of phrase notes starting with the note of LOC 1 against each melody pattern in MPRB 84. Specifically, step B7 reads from MPRB 84 MP data i.e., note and motion type of a note (MP note) in a stored melody pattern. Step B8 reads from memory 95 note classification data indicative of note and motion type of a phrase note. If the phrase note matches the MP note with respect to both the note type and the motion type (B9, B11), the routine increments LOC 2 to locate the next phrase note, locates the next MP note in the melody pattern under test (B12) and returns to step B7 for continuation of the matching process. In the matching process, if a phrase note mismatches a MP note in the melody pattern with respect to either motion type or note type, the routine disregards that melody pattern and retrieves the next melody pattern of the designated rhythm style from MPRB 85 (B13), returning to step B5.

If a succession of classification notes in the phrase matches a melody pattern, the routine will detect a terminal motion in the melody pattern at step B10. Then the routine writes a pattern match flag into each flag byte of phrase notes of classification from LOC 1 to LOC 2 (B14 to B16), increments LOC 1 (B17) to locate the next phrase note of classification with which a next matching process will start, and returns to the step B2.

If a succession of phrase notes of classification fails to match any melody pattern in MPRB 84, the routine will detect the end of MPRB 84 at step B5. Then the routine locates the next phrase note (B17) and returns to step B2.

In this manner, the matching process is repeatedly executed between each melody pattern in MPRB 84 and a succession of phrase notes starting with any note in the phrase. Those phrase notes that have matched a stored melody pattern are labeled with a pattern match flag.

Figure 20:
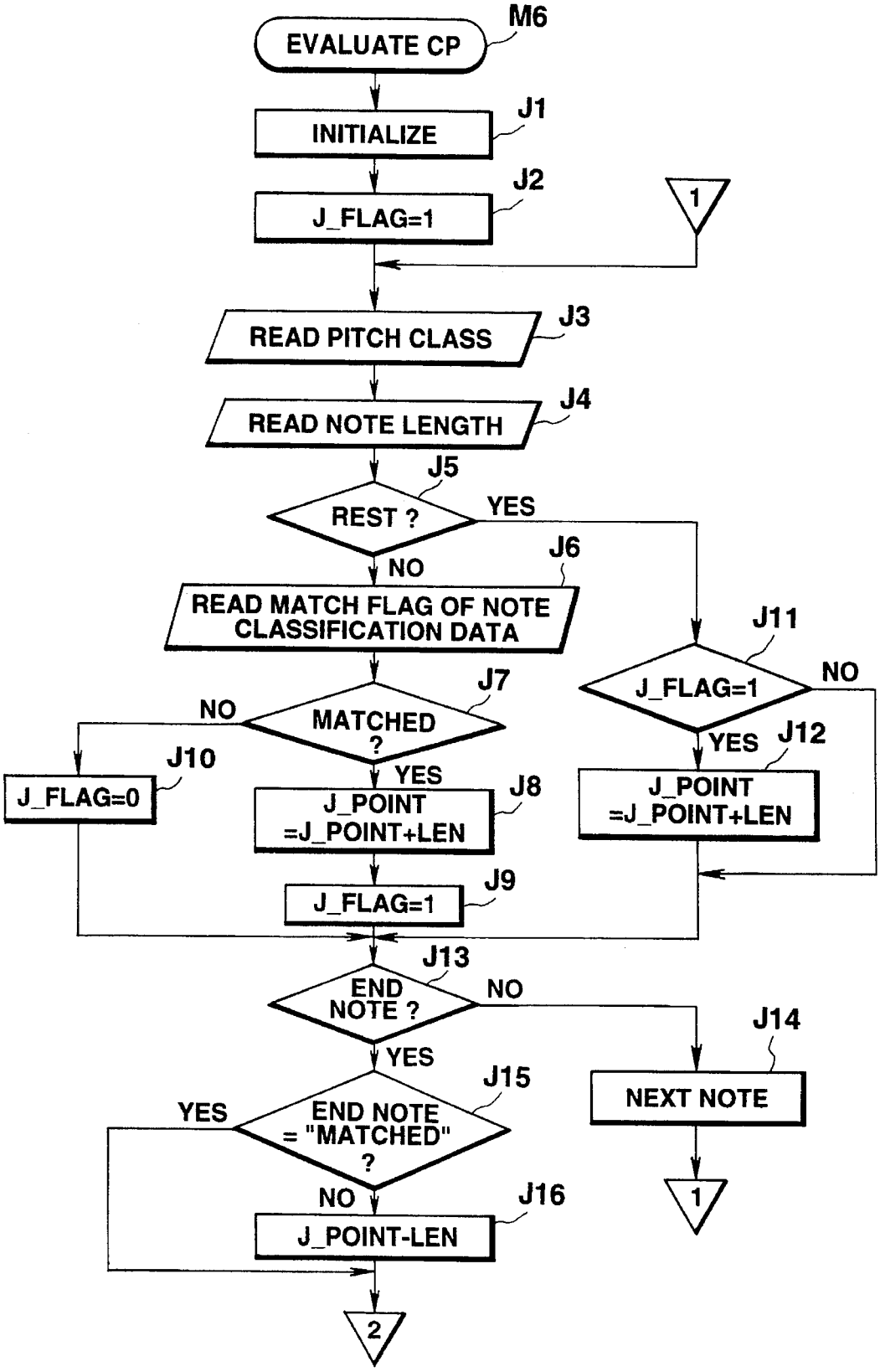
FIGS. 20 and 21 are flow charts for evaluating suitability of a chord progression.
Figure 21:
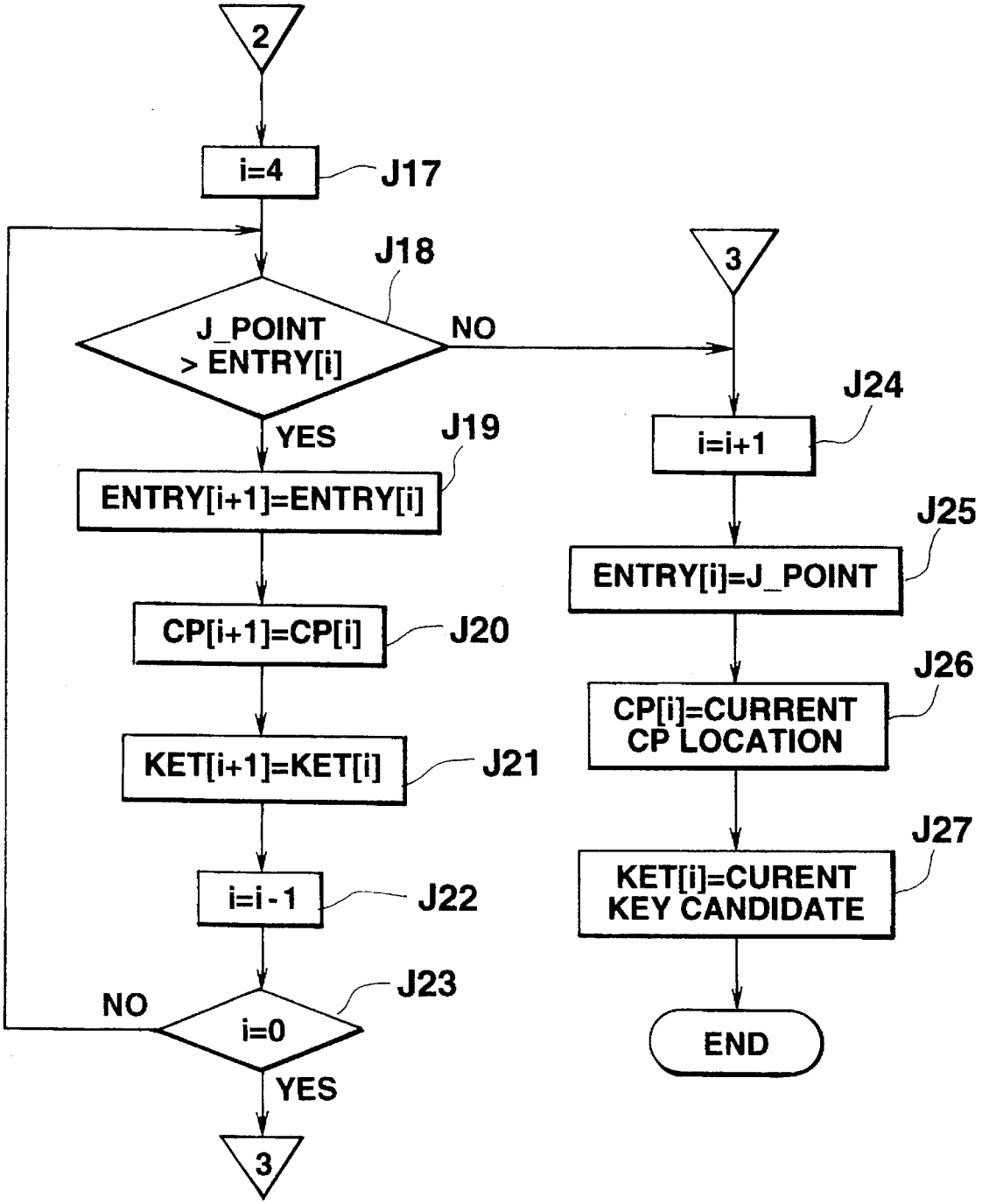

FIGS. 20 and 21 show flow charts of the evaluate chord progression routine M6. This routine computes a proportion of those phrase notes labeled with a pattern match flag to thereby evaluate suitability of a chord progression for a phrase. Further the routine records into CP entry table 97 those chord progressions having a relatively high suitability.

Specifically, initialization step J1 locates the starting point of the current phrase in the quantized melody memory 92 and the start of the note classification memory 95, and clears a CP suitability register J-POINT. Step J2 sets a J-FLAG for a rest.

Step J3 reads the pitch class PC of a phrase note. Step J4 reads the length LEN of the note. If the note is not a rest, as indicated in PC (J5), step J6 reads the flag byte of the note from the note classification memory 95. If the flag byte is set to pattern-matched (J7), the routine adds the note length LEN to suitability J-POINT (J8) and set J-FLAG (J9). If the flag byte is not set to pattern-matched, the routine resets J-FLAG (J10). The setting/resetting J-FLAG causes a succeeding rest to be regarded as pattern-matched if the rest comes after a note labeled with pattern-matched. If it comes after a note of mismatched, the succeeding rest is regarded as mismatched. Specifically, when the routine detects a rest (J5), it adds the length of the rest to CP suitability J-POINT on the condition that J-FLAG has been set (J11, J12).

If it has not reached the last note of the phrase (J13), the routine locates the next phrase note in the quantized melody memory 92 (J14) and returns to step J3.

If the last note of the phrase is not labeled with pattern-matched (J13, J15), the routine subtracts the length LEN of the last note from CP suitability J-POINT (J16) in consideration of the important function of the last note in terms of harmony and tonality.

In this manner, CP suitability of a chord progression retrieved from CPDB 82 has been evaluated.

Then the routine determines whether to enter the evaluated chord progression in CP entry table 97 as a candidate for chord progression of the phrase. The CP entry table 97 is provided for each phrase such that it stores four chord progression entries per phrase (J17). Each entry or record comprises three items of CP suitability ENTRY [i], chord progression pointer CP[i] and keynote KEY[i]. The loop of J18 to J23 sorts the elements of the CP entry table of the current phrase according to the ordinal number of the CP suitability of the evaluated chord progression. When J-POINT>ENTRY[i] is held at step J18, (i+1)-th is the ordinal number of the CP suitability of the chord progression.

Thus, the routine stores into the (i+1)-th entry record the CP suitability J-POINT of the chord progression, the location of the chord progression in CPDB 82 and the current key candidate.

The melody arranging process initiated by the arrange key 76 operation completes when the melody harmonization (FIG. 12) finishes.

Thereafter when the play key 77 is pressed, the music apparatus (FIG. 2) automatically plays the arranged music. To this end, the apparatus plays a melody by reading out the melody data from the quantized melody memory 92, makes and plays an accompaniment based on the determined chord progression and the accompaniment pattern data of the designated style, and plays a rhythm of the designated style.

The melody harmonization (chord progression for the melody) may preferably be varied each time of playing the arranged results. This will allow a user to enjoy various music arrangements.

To this end, the music apparatus may choose a chord progression of each phrase from CP entry table 97 either at random or in the order of the entries. In this case, the step M11 in FIG. 12 is omitted.

Figure 22:
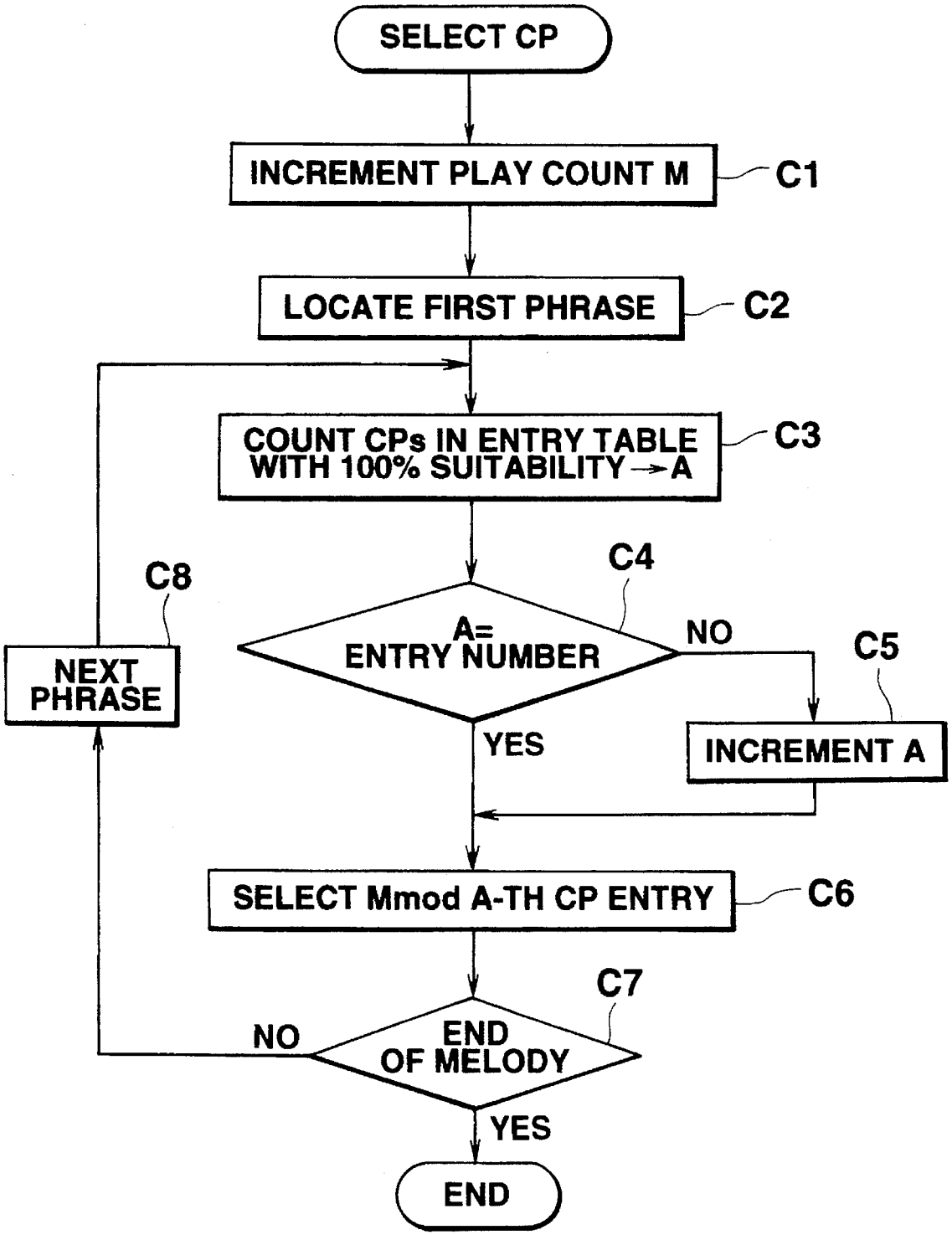
FIG. 22 is a flow chart for selecting a chord progression.

Another example of selecting CP is shown in the flow chart of FIG. 22. In this example, the music apparatus selects the next CP entry from CP entry table 97 with respect to each phrase and uses it to play an accompaniment at this time if the chord progression used for the previous performance of an accompaniment has CP suitability of 100 percent (J-POINT/phrase length=1). If the chord progression previously used has CP suitability less than 100 percent, the music apparatus selects the first CP entry (i.e., the one having the highest CP suitability) for each phrase. In the first performance of the arranged music, the first CP entry is selected for each phrase.

Specifically, step C1 increments play count M. Step C2 locates the first phrase. Step C3 counts chord progression entries with 100 percent suitability in CP entry table of a current phrase to get the count A. If A is equal to the number of entries (four in FIG. 21), A is not changed whereas if A is smaller than the number of entries (C4), A is incremented by one (C5). Step C6 selects M mod A-th chord progression entry in the CP table of the current phrase and writes the chord progression and the keynote into a play buffer (not shown). The next phrase is located (C8) and the above CP selecting process repeats for all phrases of the melody (C7).

Thereafter, the music apparatus uses the play buffer having stored the chord progression and keynote of each phrase to play a musical accompaniment.

To assure a satisfactory music arrangement, it is desirable to provide a CP correction feature which corrects a chord progression with CP suitability less than 100 percent into the one having higher suitability.

Figure 23:
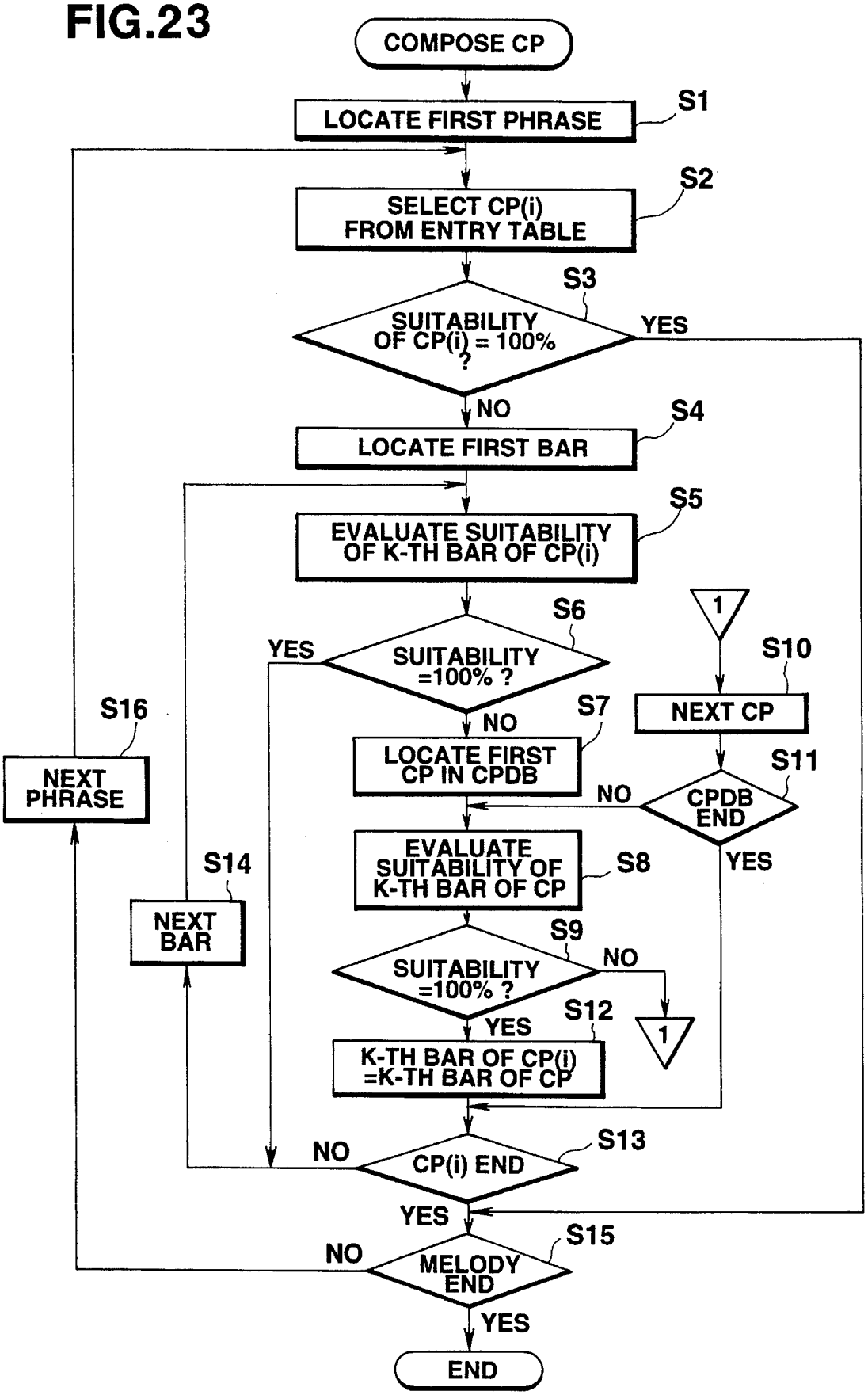
FIG. 23 is a flow chart for composing a chord progression.

This is realized by the provision of a compose CP routine shown in FIG. 23.

Step S1 in the compose CP routine locates the first phase of the melody as a current phrase. Step S2 selects one of the CP entries from the CP entry table of the current phrase according to a random number or a method described in connection with FIG. 21.

If the selected chord progression entry has 100 percent suitability (S3), the process will move to the next phrase without any correction of the chord progression (S16).

On the other hand, if the CP suitability of the selected entry is less than 100 percent (S3), the routine goes to step S4 to locate the first bar (as K-th bar with K=1) of the chord progression CP(i) of the entry. Step S5 evaluates suitability of K-th bar of the chord progression CP(i). If the suitability of the K-th bar is 100 percent (S6), K is incremented to the next bar (S14).

If the suitability of the K-th bar of the chord progression CP(i) is less than 100 percent (S6), the routine searches through CPDB 82 for a chord progression CP of the current phrase length and the designated style and having the K-th bar with 100 percent suitability, and rewrites the K-th bar of CP(i) with that of the searched chord progression CP (S7 to S12). Specifically, step S7 locates a first chord progression CP in CPDB 82 having the attribute matching the current phrase length and the designated rhythm style. Step S8 evaluates suitability of the K-th bar of the CP. If the suitability is 100 percent (S9), step S12 corrects the chord progression CP(i) by setting K-th bar of CP(i) equal to K-th bar of CP. If the suitability of K-th bar of CP is less than 100 percent (S9), the routine locates a next chord progression in CPDB meeting the condition of the designated style and the current phrase length (S10) and returns to step S5 by way of S11. If CPDB does not include a CP having K-th bar of 100 percent suitability (S11), the process moves to the next bar (S14) without changing the K-th bar of the chord progression CP(i).

In the alternative, K-th bar of CP(i) may be replaced by K-th bar of a CP in CPDB, of the designated style and the phrase length and having the K-th bar of the highest suitability.

The above process repeats for all bars of the chord progression CP(i) (S13).

Step S15 checks if CP composing or correction process has completed for chord progressions of all phrases. If not, the next phrase is located (S16) for continuation of the process.

The CP composing process discussed above serves in effect to expand a virtual space of CPDB 82. Unlike the prior art melody reharmonization which simply replaces a chord with a substitute without any substatial musical grounds, the present CP correcting technique composes a chord progression from CP records stored in CPDB 82 and having the attribute of the designated style and the phrase length according to the suitability criterion while keeping the time corrrespondence. This will assure naturalness of the composed chord progression.

The first embodiment of the invention has been described. A second embodiment of the invention is now described.

Figure 24:
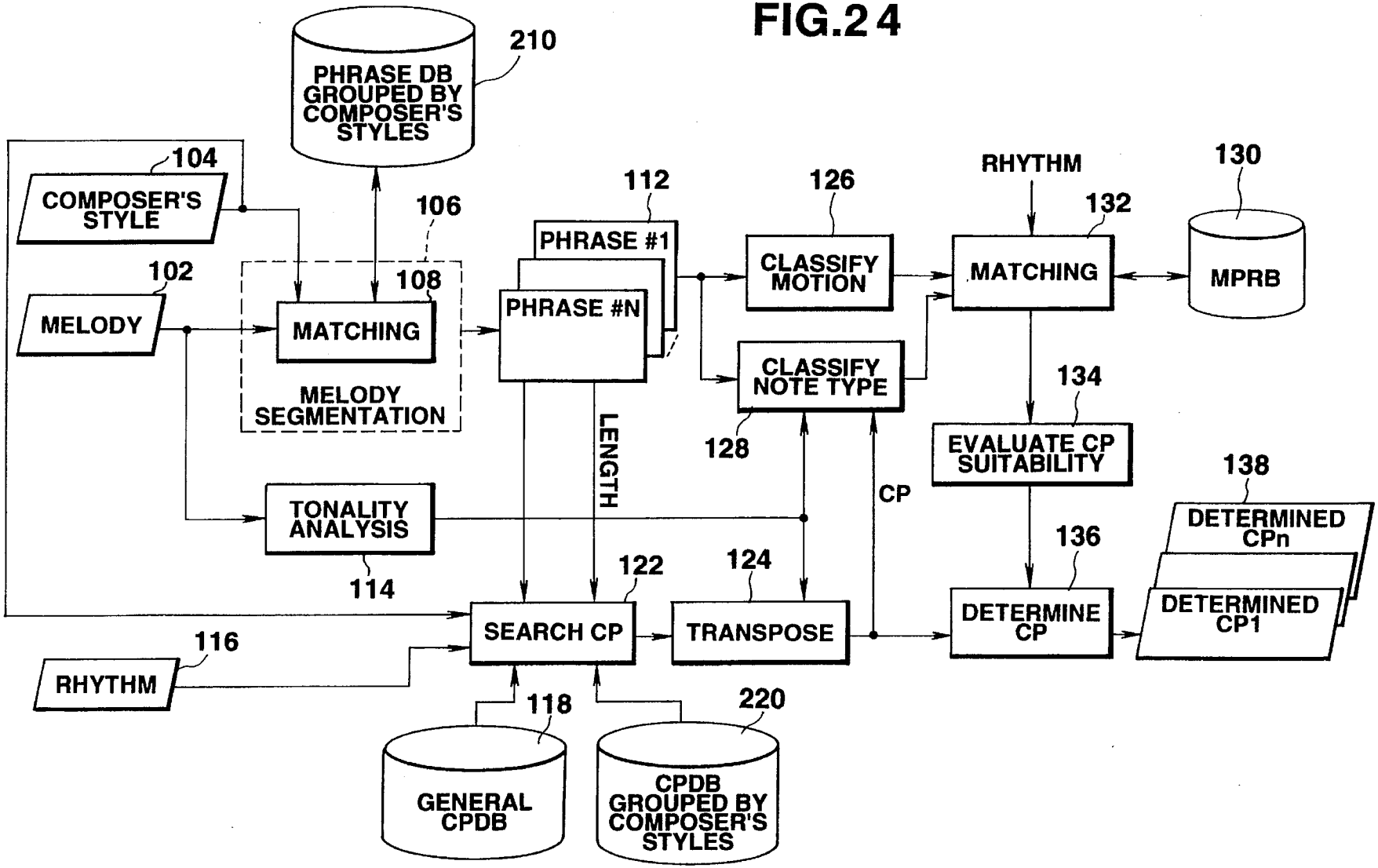
FIG. 24 is a functional block diagram of an apparatus for analyzing and harmonizing a melody in accordance with a second embodiment of the invention.

FIG. 24 shows a functional block diagram of a music apparatus for analyzing and harmonizing a melody in accordance with the second embodiment of the invention.

A melody segmentation module 106 segments a given melody 102 into a plurality of phrases 112.

In accordance with the invention, the melody segmentation module 106 includes a phrase matching block 108. The matching block 108 extracts from the melody 102 a melody portion or phrase matching a designated composer's style representative of a music style desired by a user and labels the phrase with style-matched.

To this end, there is provided a composer phrase database memory 210. The memory 210 stores a database of phrases grouped by composers' styles. The matching block 108 matches a portion of the melody 102 against a phrase collection of the designated composer's style stored in the database 210 and labels the melody portion with style-matched if it matches a phrase in the phrase collection.

A tonality analyzing module 114 determines a tonality or key of the given melody. The resultant key information is supplied to a note type classifying module 128 and a transposing module 124.

To assign a chord progression to each phrase 112, the music apparatus comprises a general chord progression database (CPDB) memory 118 and a composer CPDB memory 220. The general CPDB memory 118 stores a collection of chord progressions of various rhythm styles irrespective of composers' styles whereas the composer CPDB memory 220 stores a collection of chord progressions grouped by composers' styles.

CP search module 122 searches the composer CPDB 220 for a phrase labeled with style-matched whereas for a phase without a style-matched label it searches the general CPDB 118.

Specifically, the CP search module 122 receives the presence/absence of a style-matched label of a phrase 112, phrase length and a designated rhythm style 116. In the absence of the style-matched label of the phrase 112, CP search module 122 searches through the general CPDB 118 for a chord progression meeting the condition of the designated rhythm style 116 and the phrase length. On the other hand, if the phrase 112 is labeled with the style-matched, CP search module 122 searches through the composer CPDB 220 for a chord progression meeting the designated composer's style 104, the designated rhythm style 116 and the phrase length.

The motion classifying module 126 and the note type classifying module 128 interpret the function of each note in a phrase 112. The motion classifying module 126 classifies a motion between adjacent notes as a function of the pitch difference or interval therebetween. The note type classifying module 128 classifies a note type of each phrase note based on the melody key information from the tonality analizing module 114 and a chord progression (candidate) of the phrase retrieved from CPDB 118 or 220.

A melody pattern rule base (MPRB) memory 130 stores a rule base of melody patterns available in respective music styles. A matching module 132 receives note classification data of each note from the motion classifying module 126 and note type classifying module 128 and tests the note classification data to see whether it meets a melody pattern of the designated style 116. To this end, the matching module 132 retrieves from MPRB 130 a melody pattern of the designated rhythm style 116 and matches it against the note classification data. Those notes in the phrase which have matched a melody pattern are labeled with "pattern matched."

The operation of the note type classifying module 128 depends on a retrieved chord progression. Thus, if the retrieved chord progression is not suitable for a phrase, the matching module 132 will yield a relatively large number of phrase notes mismatching a melody pattern rule. In other words, a proportion of phrase notes having a pattern-matched label is a measure of suitability of a retrieved chord progression for the phrase. The classification results from the note type classifying module 128 which also depends on a phrase key determined by the tonality analyzing module 114. If the tonality analyzing module provides a wrong melody key, this will decrease the proportion of phrase notes labeled with pattern-matched.

It is, therefore, preferred that the tonality analyzing module 114 generates a plurality of keys as key candidates of a melody in consideration of all key possibilities of the melody.

A suitability evaluating module 134 receives results from the matching module 132 to evaluate suitability of a chord progression by computing the proportion of phrase notes labeled with pattern-matched.

A determining module 136 selects from among retrieved chord progressions a chord progression with the highest suitability, as a determined chord progression for a phrase. A reference numeral 138 denotes determined chord progressions in which DETERMINED CP 1 indicates a chord progression for a first phrase and DETERMINED CPn indicates a chord progression determined for an n-th phrase.

As understood from the foregoing, the present music apparatus can analyze a given melody 102 for a desired music style by the provision of the composer phrase database 210 storing a collection of phrases grouped by composers' styles and the phrase matching block 108 for matching a melody phrase against the composer phrase database and the designated composer's style 104 as the desired music style. Further, the music apparatus utilizes the style-analysis of the melody from the phrase matching block 108 to search through the composer CPDB 220 to assign a chord progression of the designated composer's style to a phrase having the same style.

Figure 25:
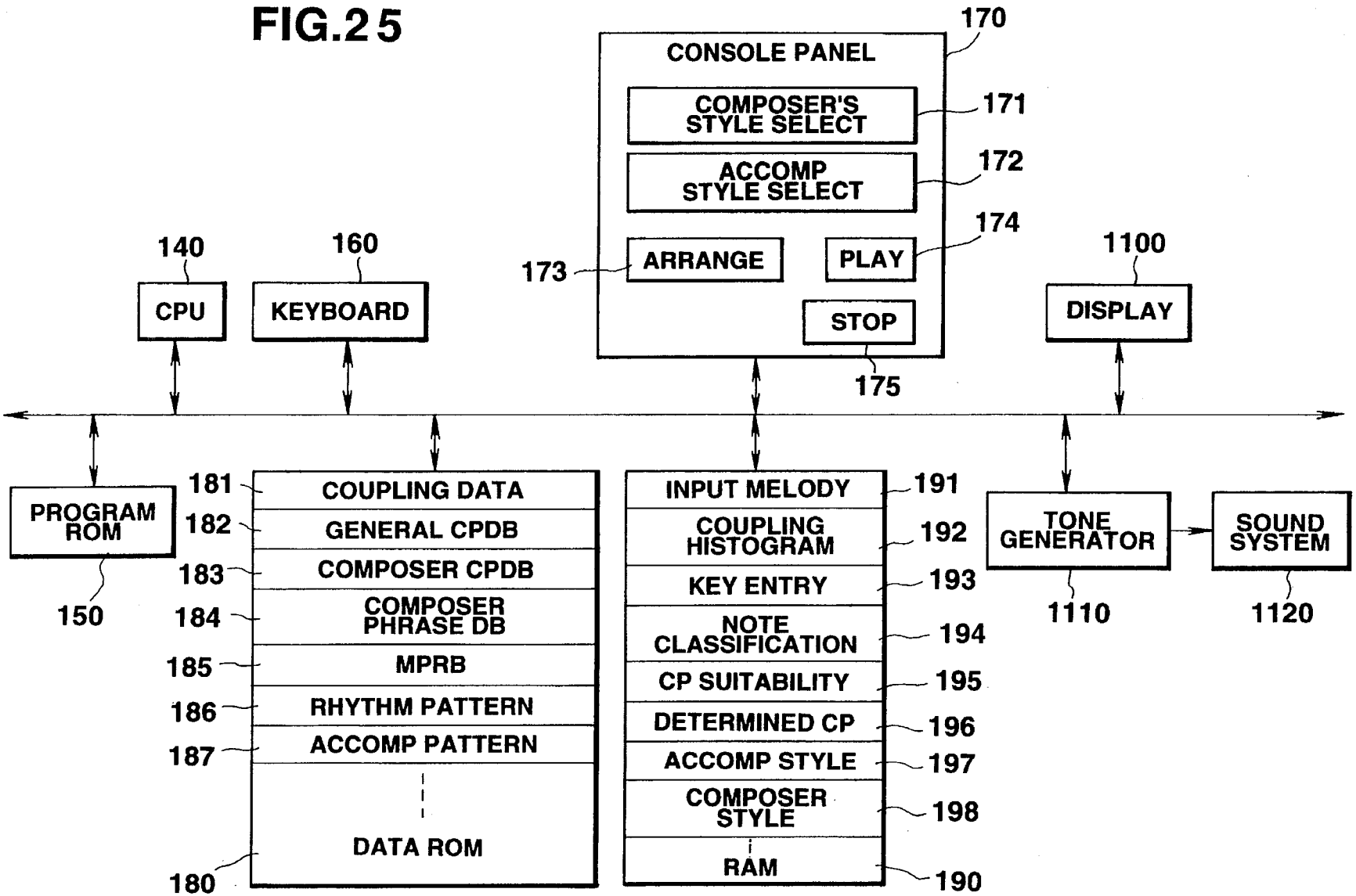
FIG. 25 is a block diagram showing a hardware organization of a music apparatus in accordance with the second embodiment of the invention.

FIG. 25 shows a block diagram of a hardware organization of a music apparatus (configured here as an electronic keyboard instrument) in accordance with the second embodiment of the invention.

CPU 140 operates according to a program stored in a program ROM 150 to control the entire system. A keyboard 160 may be identical with a musical keyboard of a conventional electronic keyboard instrument and is used for music performance. A consol panel 170 comprises a cmposer's style select key 171 for selecting a desired composer's style, a rhythm select key 172 for designating a desired rhythm or accompaniment style, an arrange key 173 for requesting the apparatus to arrange (harmonize with accompaniment) a recorded melody, a play key 174 for causing automatic play of the arranged music, a stop key 175 for stopping the play of the arranged music, and other keys and switches required for the operation of the music apparatus.

A data ROM 180 stores permanent data and includes a note coupling coefficient memory 181 used in tonality analysis, a general chord progression database (CPDB) memory 182, a composer CPDB 183, a composer phrase database 184, a melody pattern rule base (MPRB) memory 185, a rhythm pattern data memory 186 for storing rhythm patterns of various styles, and an accompaniment pattern data memory 187 for storing accompaniment patterns of various styles.

A RAM 190 includes an input melody memory 191 for storing an input melody i.e., the one played by the keyboard 160, a coupling histogram memory 192 for storing a coupling histogram of notes in a phrase (melody segment), a key entry table memory 193 for storing key candidates of each phrase, note classification memory 194 for storing classification data of phrase notes, a CP suitability memory 195 for storing suitability of a chord progression, a determined chord progression memory 196 for storing a determined chord progression of each phrase, an accompaniment style memory 197 for storing a designated accompaniment (rhythm) style, and a composer's style memory 198 for storing a designated composer's style.

A display device 1100 includes LED display elements and an LCD display panel arranged over the console panel 170.

A tone generator 1110 generates a tone signal under the control of CPU 140.

A sound system 1120 includes amplifiers and loud-speakers for reproducing a sound.

Figure 26:
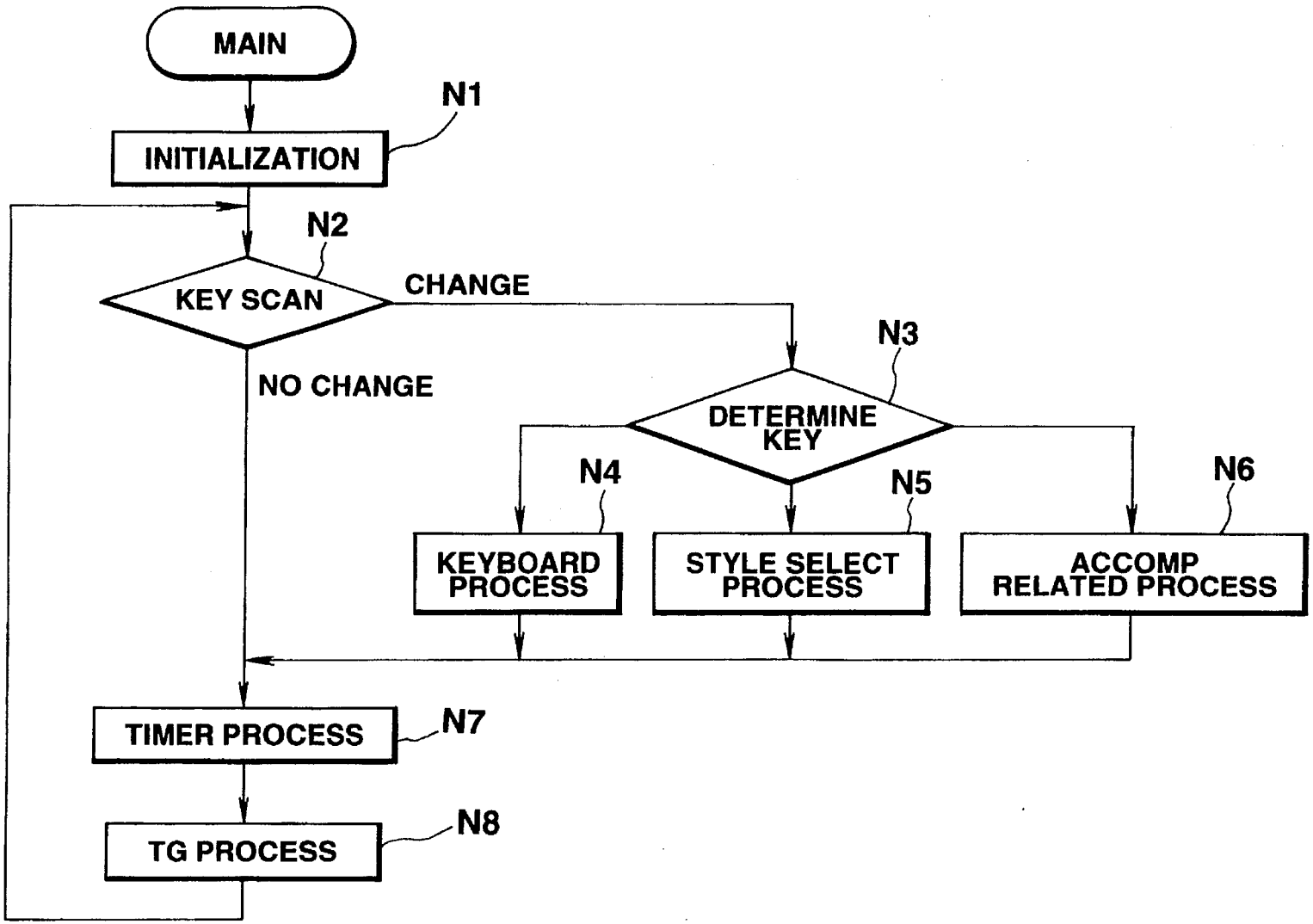
FIG. 26 is a flow chart of a main routine.

FIG. 26 shows a flow chart of a main routine to be executed by CPU 140, illustrating the overall operation of the second embodiment.

Step N1 initializes the system. Step N2 reads the keyboard 160 and individual keys on the console panel 170. If a key state has changed, the changed key is determined (N3) to execute a corresponding process. The keyboard process N4 is performed in response to a key state change on the keyboard 160 and involves assigning a voice channel in the tone generator 1110. The style select process N5 and the accompaniment related process N6 will be described later. A timer process N7 comprises controlling various timers (e.g., a timer for controlling a note signal, a timer for keeping the tempo of an automatic music performance), and reading data for the automatic performance. A TG process N8 comprises controlling voice channels in the tone generator 1110.

Figure 27:
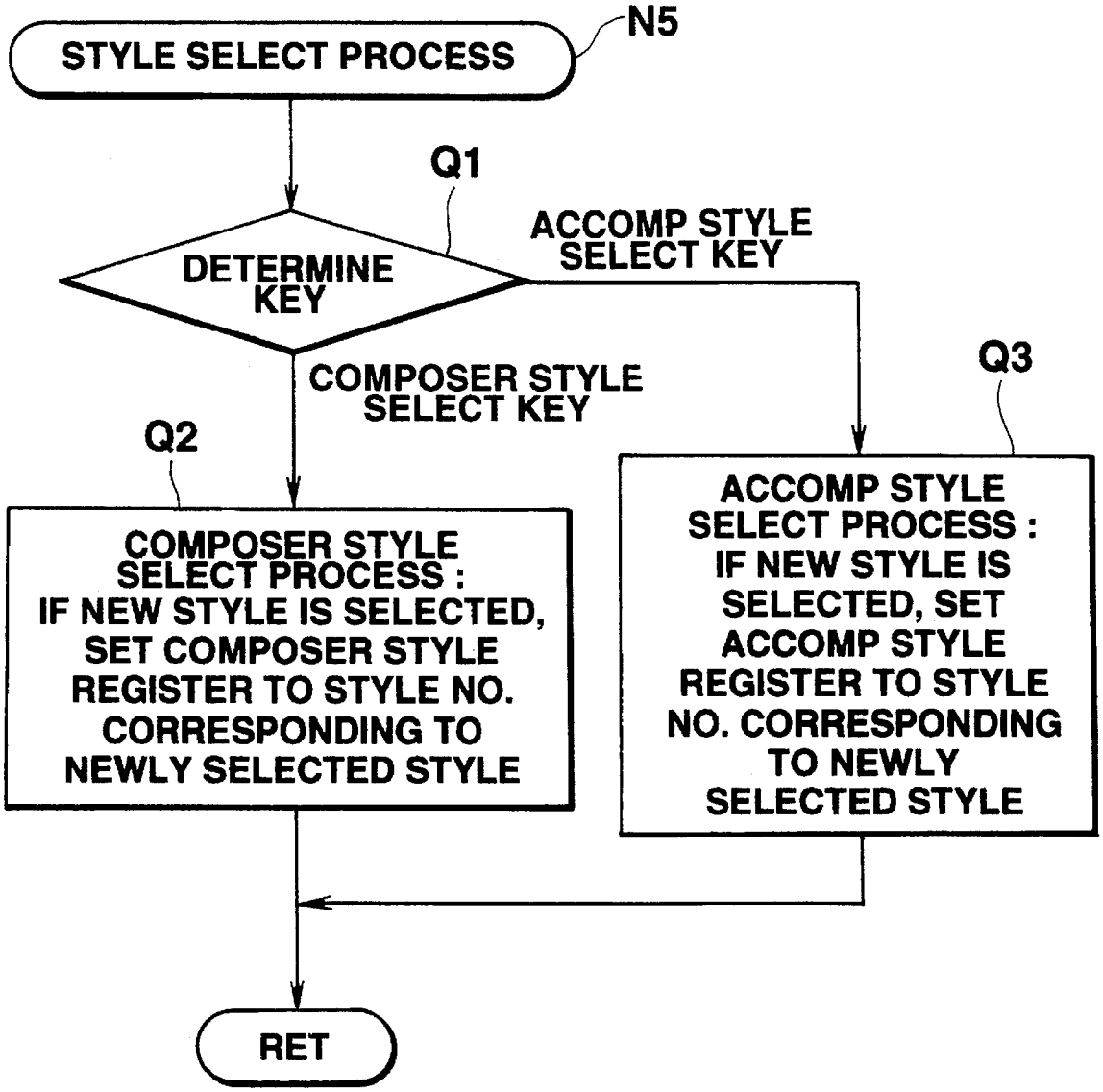
FIG. 27 is a flow chart of a style select process.

FIG. 27 shows a flow chart of the style select process N5. When an accompaniment style select key 171 is pressed (Q1), an accompaniment style select process Q3 is executed to set the accompaniment style register 197 to an accompaniment style number specified by the key operation. When a composer's style select key 172 is pressed (Q1), a composer style select process Q2 is executed to set the composer's style register 198 to a composer's style number specified by the key operation.

Figure 28:
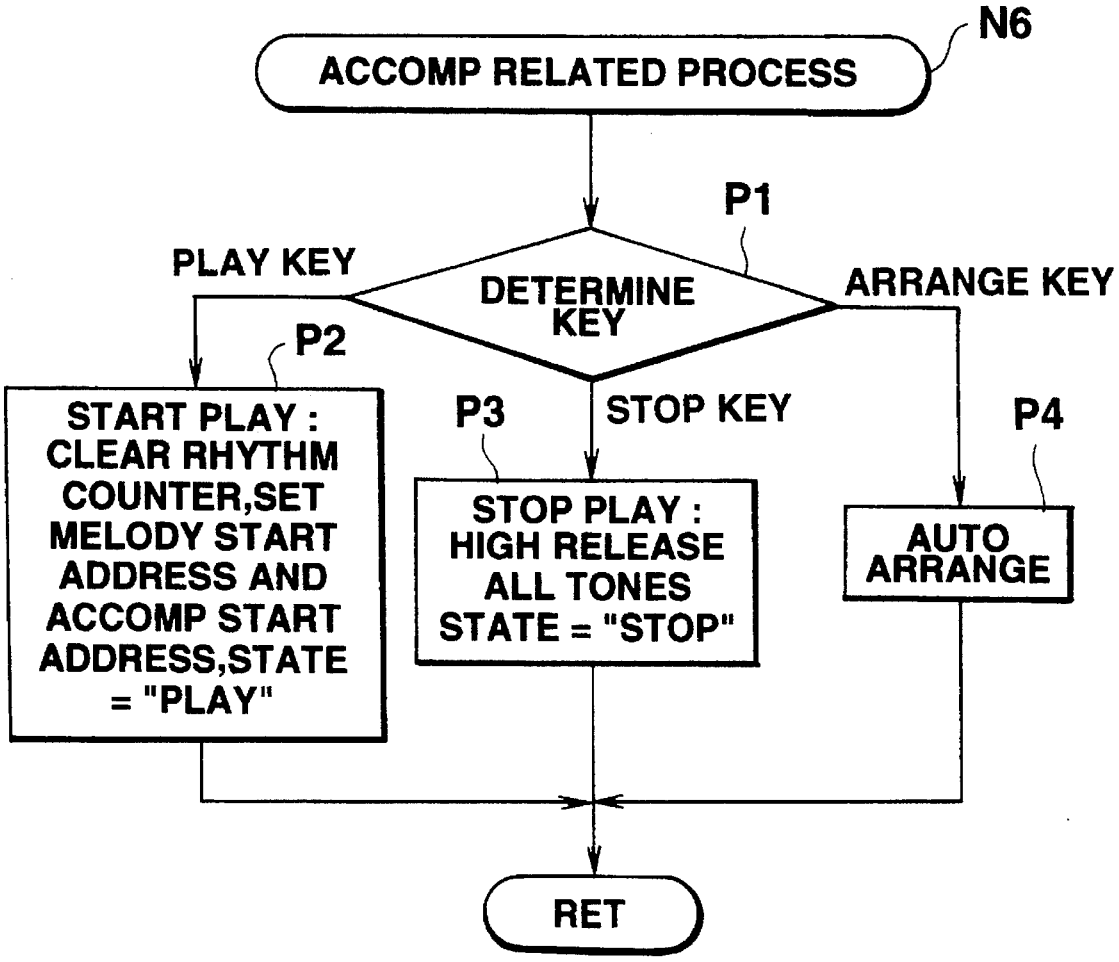
FIG. 28 is a flow chart of an accompaniment related process.

FIG. 28 shows a flow chart of the accompaniment related process N6. When the arrange key 173 is pressed (P1), CPU 140 executes an automatic arranging process P4 for the recorded melody as will be detailed. When the play key 174 is pressed, a start play process P2 is executed to clear a rhythm counter, set the start address of the melody memory 191 and the accompaniment start addresses (i.e., the start address of the accompaniment pattern memory of the designated accompaniment style, start address of the rhythm pattern memory and the start address of the determined chord progression memory), and set a state flag to "PLAY." This starts an automatic performance of an arranged music. In response to a stop key 175 operation, CPU 140 executes a stop play process P3 to high release all tones and set the state flag to "STOP."

Figure 29:
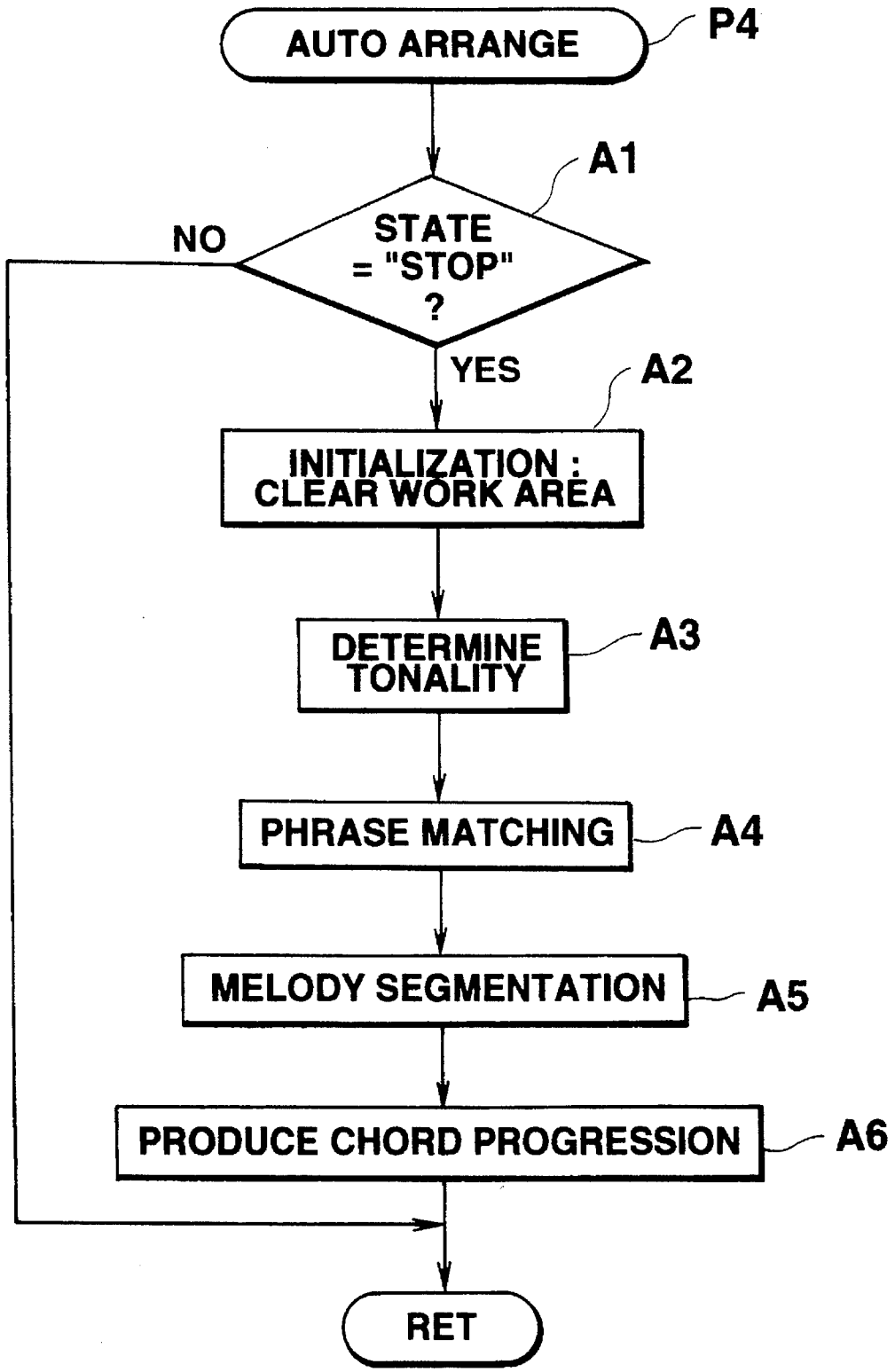
FIG. 29 is a flow chart of an automatic arrangement process.

FIG. 29 shows a flow chart of the automatic arranging process P4. Stop A1 tests the state flag. Only when the automatic performance is in the stop or inactive state, the task of arranging a melody is executed (A2 to A6). Specifically, an initialization step A2 clears a work area in RAM 194. Step A3 determines tonality of the melody. A phrase matching step A4 matches the melody against the composer phrase database to detect a melody portion (phrase) matching the designated composer's style. A melody segmentation step A5 segments the melody into a plurality of phrases. A step A6 produces a chord progression of each phrase.

The steps or routines A3 to A6 will now be described in more detail.

Figure 30:
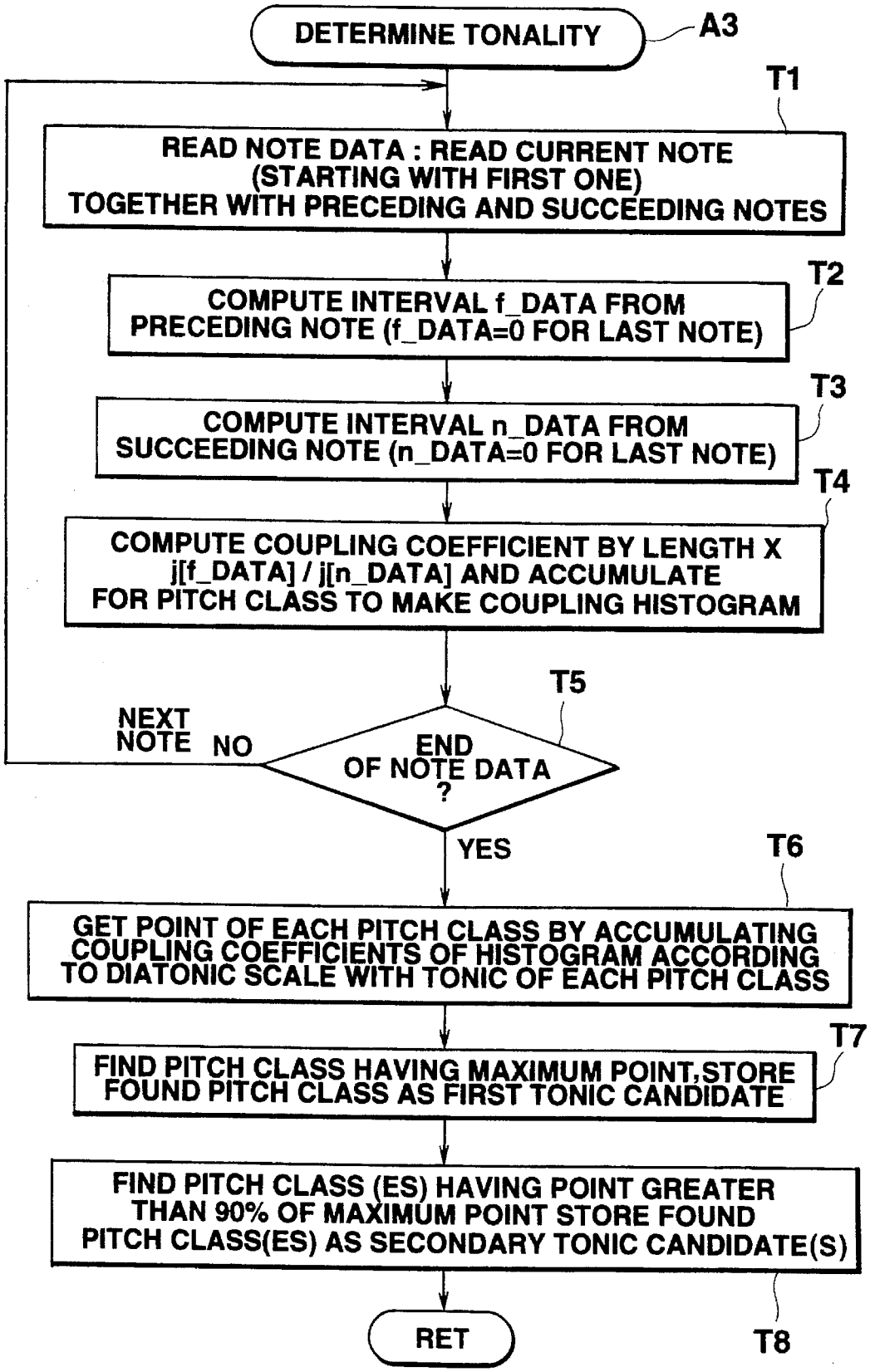
FIG. 30 is a flow chart for determining tonality.
Figure 31:
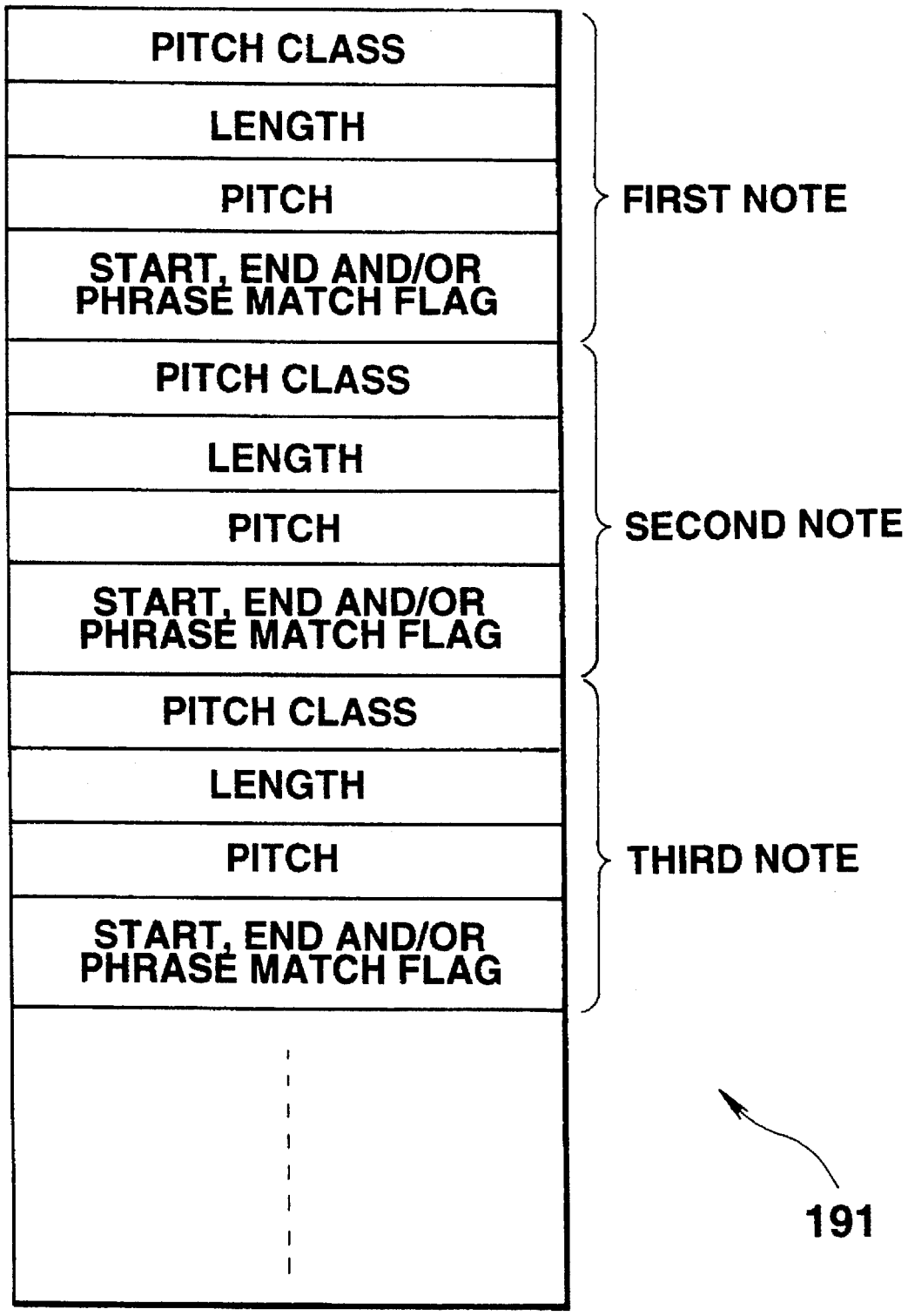
FIG. 31 shows data format of a melody memory.
Figure 32:
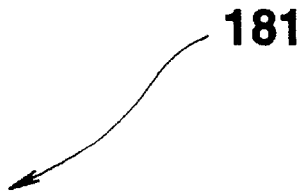
FIG. 32 shows note coupling coefficient data.

According to a flow chart in FIG. 30, the determine tonality routine A3 successively reads note records in the melody memory 191 (FIG. 31), of current, preceding and succeeding notes (T1). The routine A3 computes a pitch interval f-data of the current note from the preceding note (T2) and a pitch interval n-data to the succeeding note (T3). Using these intervals, the routine looks up (T4) the coupling data memory 181 (FIG. 32) to obtain j[f-data] and j[n-data] and computes the coupling coefficient of the current note by:

$$\text{note length} \times j[\text{f-data}]/j[\text{n-data}]$$

The routine adds the coupling coefficient to an element of the coupling histogram 192 for the current note pitch class.

The above process (T1 to T4) repeats for all melody notes (T5) to complete the coupling histogram.

Then, using the coupling histogram 192, step T6 computes a tonic point for each of the tonic pitch classes C to B by accumulating the coupling coefficients of the histogram 192 according to a diatonic scale starting with the tonic. Step T7 finds the tonic pitch class having yielded the maximum point and records it as the first key candidate of the melody into the key entry table 193. Step T8 finds other tonic pitch classes having a point greater than 90 percent of the maximum point and records them as the second, and the following candidates for the melody key into the key entry table 193.

Figure 33:
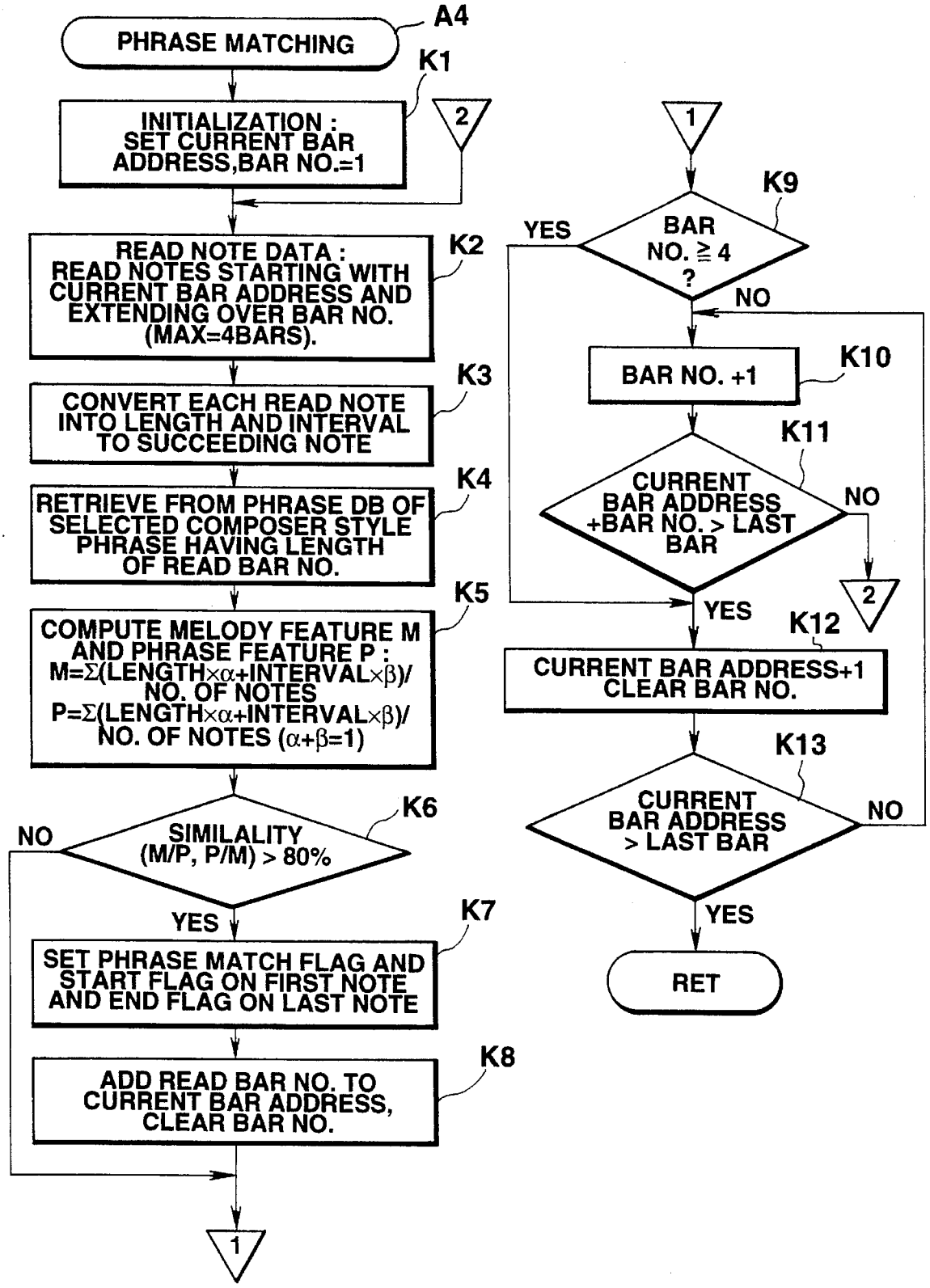
FIG. 33 shows a flow chart of a phrase database grouped by composer styles.

As shown in FIG. 33, the phrase matching routine A4 first executes an initialization step K1 to set a current bar address to the starting point of the melody memory 191 and initialize a number of bars to be read, BAR NO to "1."

Figure 34:
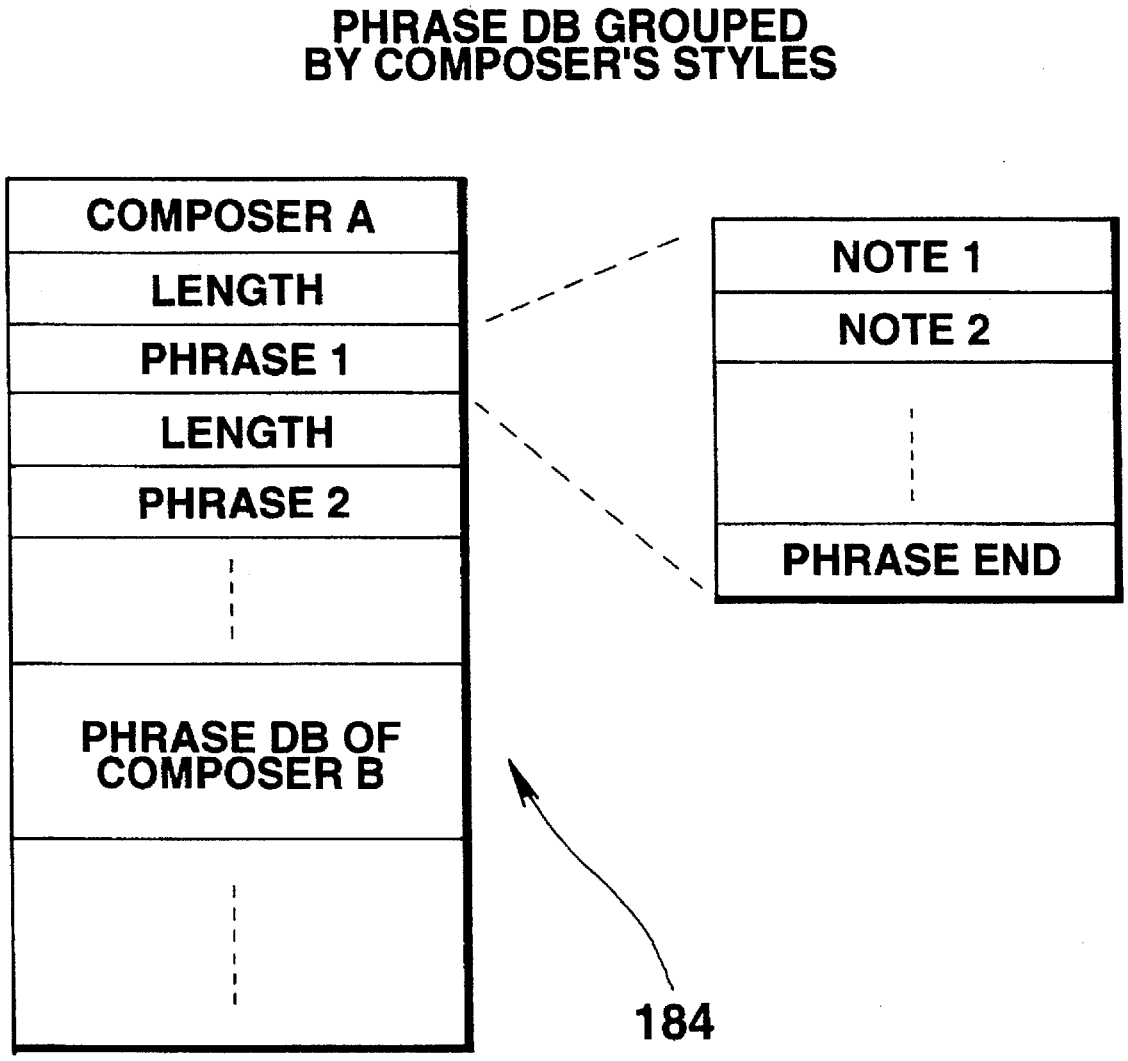
FIG. 34 shows a format of a phrase database grouped by composer styles.

Then step K2 reads notes in the area starting with the current bar address and extending over BAR NO. A note in a succeeding bar is also read if it is connected to a preceding note through a tie. BAR NO is incremented. Step K3 converts each read note into length and interval to a succeeding note. Step K4 retrieves, from the composer phrase database 184 (see FIG. 34), a phrase of the designated composer's style and having the length corresponding to BAR NO. Then step K5 computes similarity between the melody portion formed by those notes read in step K2 and the phrase retrieved in step K4 from composer phrase database 184. The similarity is given by M/P or P/M in which M indicates a feature of the melody portion, and P indicates a feature of the retrieved phrase of the designatted composer's style. M and P are evaluated by $$M = \Sigma(\text{NOTE LENGTH} \times \alpha + \text{INTERVAL} \times \beta/\text{NO. OF NOTES}$$

$$P = \Sigma(\text{NOTE LENGTH} \times \alpha + \text{INTERVAL} \times \beta/\text{NO. OF NOTES}$$

in which $(\alpha+\beta)=1$.

If the similarity M/P or P/M is greater than a predetermined value e.g., 80 percent (K6), the phrase matching routine A4 recognizes the melody portion as a phrase and labels it with style-matched. Specifically, step K7 sets a style match flag and a phrase start flag on the first note of the melody portion, and sets a phrase end flag on the last note of the melody portion. Then step K8 increments the current bar address by BAR NO, and clears, BAR NO. After step K8 or if the melody portion fails the similarity test K6, step K9 checks if BAR NO≧4. In the negative, BAR NO is incremented by one (K10). If the current bar address plus BAR NO does not exceed the last of the melody (K11), the routine A4 returns to the step K2. If the current bar address plus BAR NO exceeds the last bar of the melody (K11) or if BAR NO.≧4 at step K9, the current bar address is incremented by one and BAR NO is cleared (K12). Step K13 checks if the current bar address exceeds the last bar of the melody. In the negative, the routine A4 returns to step K10. In the affirmative, the phrase matching routine A4 terminates.

In this manner, those portions of the melody which have matched a phrase of the designated composer's style in the composer phrase database are each labeled with a style-matched flag as well as a phrase start flag at the starting point and a phrase end flag at the ending point of each melody portion. This means that such melody portions are phrases meeting the designated composer's style.

Figure 35:
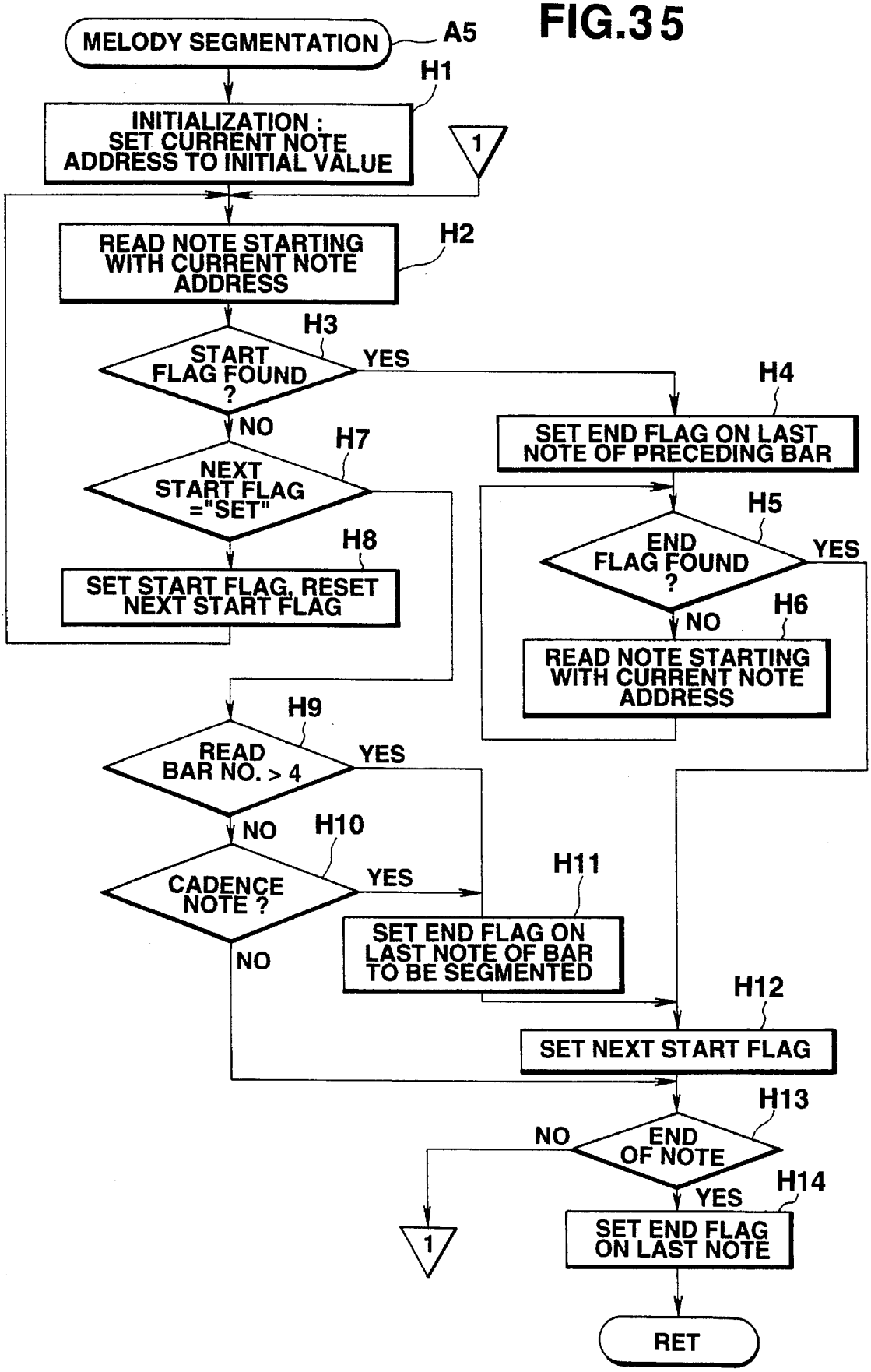
FIG. 35 is a flow chart of a melody segmentation process.

The melody segmentation routine A5 is executed after the phrase matching process A4. The details of the melody segmentation routine A5 are shown in FIG. 35 by steps H1 to H14 in a flow chart. The melody segmentation routine A5 segments the melody (which have been partly segmented by the phrase matchiing routine A4) into a plurality of phrases based on the following conditions: (1) Segment the melody into four-bar phrases (H9, H11), and (2) When a cadence note i.e., a note longer than ¾ of a bar is detected (H10) a phrase is segmented from the melody (H11) such that (a) the phrase ends at the bar line succeeding the cadence note if it ends before the center of the bar, or (b) if it ends after the bar center, the phrase ends at the bar line preceding the cadence note. Each phrase or melody segment is labeled with a phrase start flag on the first note and a phrase end flag on the last note of the phrase (H8, H11).

Figure 36:
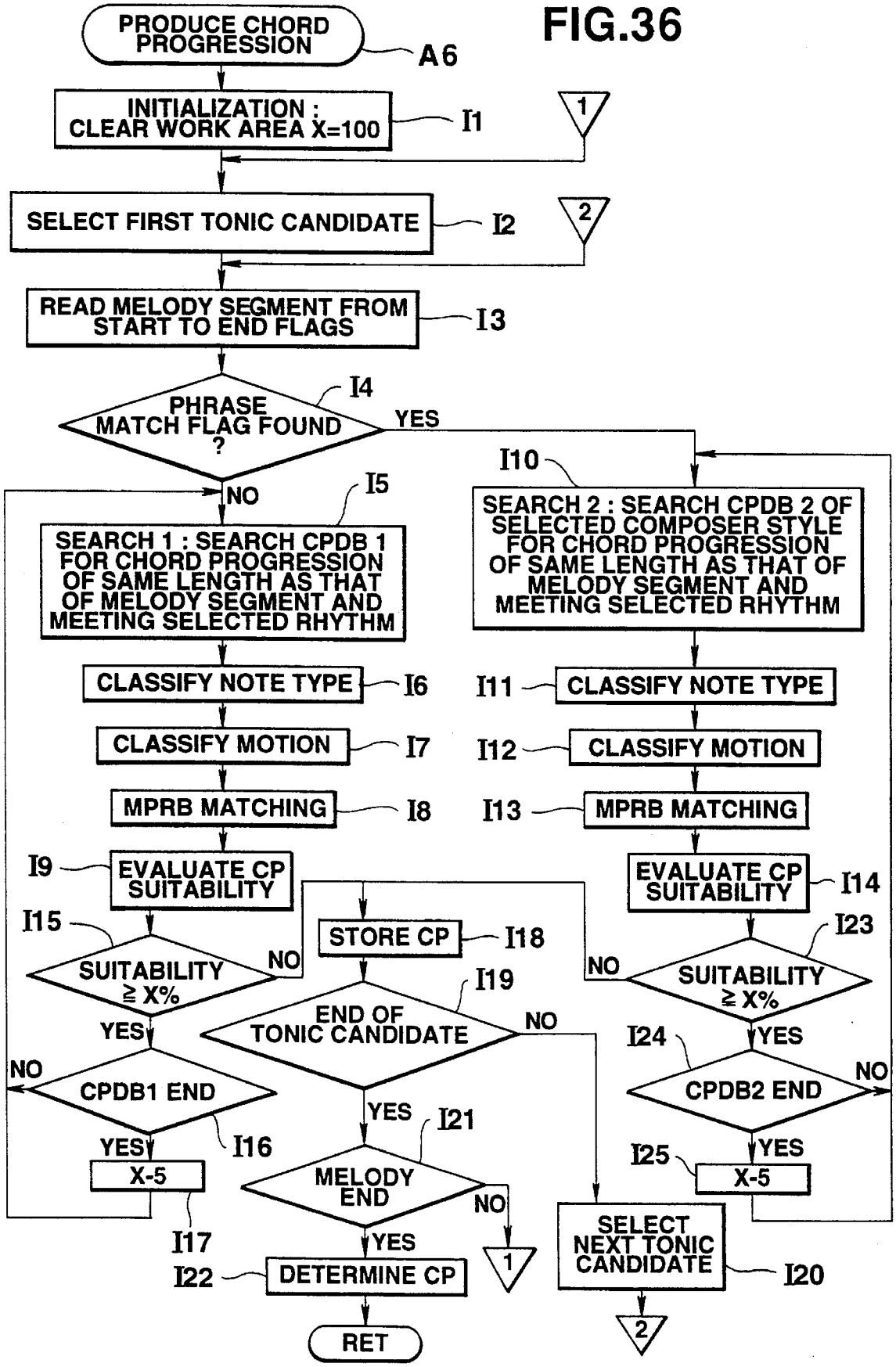
FIG. 36 is a flow chart for producing a chord progression for a melody.

FIG. 36 shows a flow chart of the produce chord progression routine A6. After the initialization I1, the routine A6 selects the first tonic (key) candidate of the melody from the key entry table 193 (I2). Then the routine reads a melody segment (phrase) from the melody memory (I3) and checks (I4) if a phrase style match flag is set on the phrase.

In the negative, search 1 is executed (I5) whereas in the affirmative, search 2 is executed (I10). The search 1 searches through the general chord progression database 182 to retrieve a chord progression for the phrase. On the other hand, the search 2 searches through the composer chord progression database 183 portion of the designated composer's style to get a desired chord progression. In doing so, the music apparatus can assign a chord progression or pattern characteristic of the selected composer to a melody segment (phrase) having matched the same composer's style in the phrase matching process. Specifically, the search 1 retrieves, from the general CPDB 182, a chord progression having the length of the melody segment and the designated rhythm style and loads it into a work area in RAM 190. The search 2 retrieves, from the composer CPDB 183 of the selected composer's style, a chord progression thus having the selected composer's style as well as the length of the melody segment and the designated rhythm style, and loads it into the work area.

Figure 37:
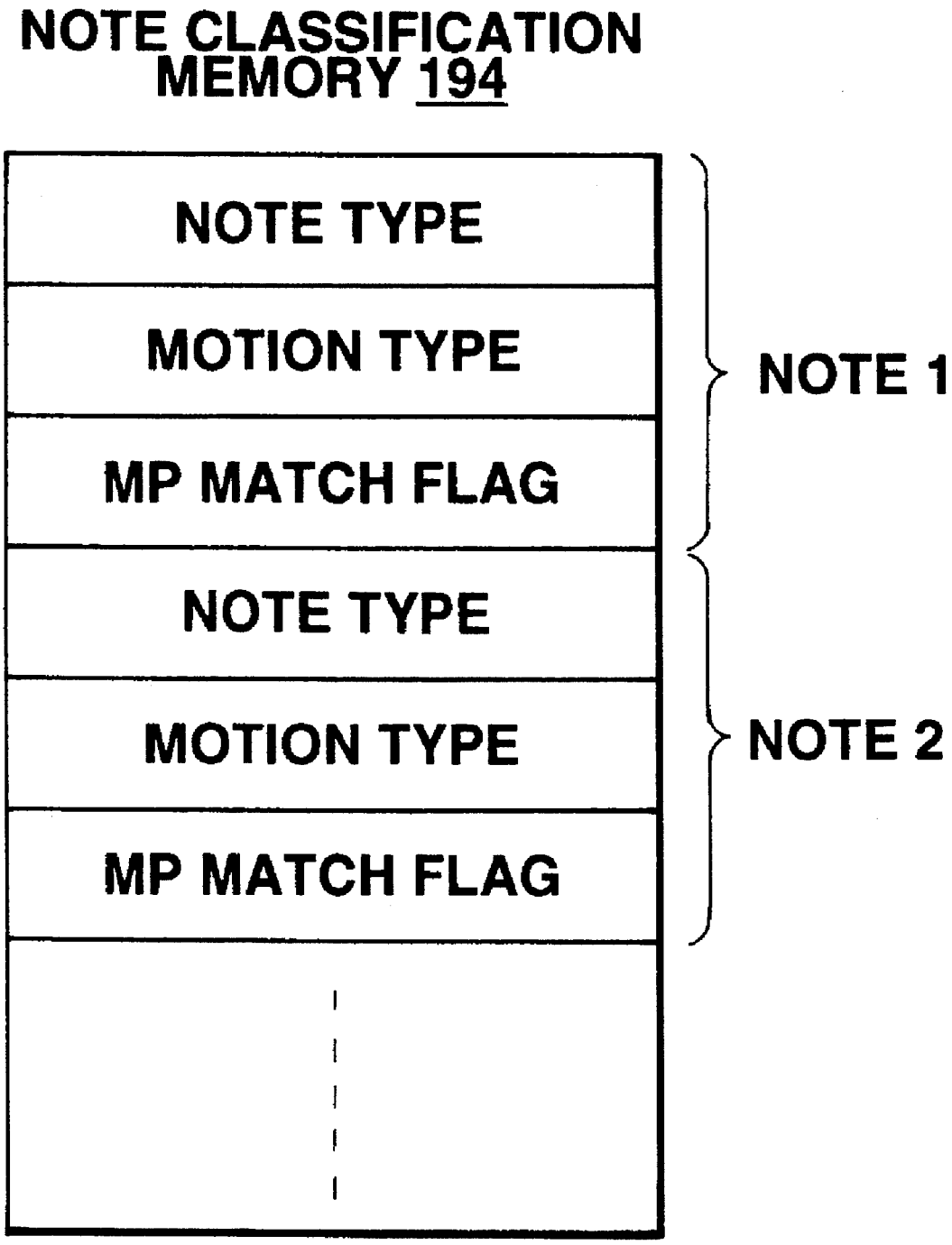
FIG. 37 shows a format of a note classification memory.

The chord progression thus retrieved is similarly evaluated (I6 to I9 and I11 to I14). To this end, the meaning of each note in the melody segment is interpreted by executing a classify note type step I6, I11, a classify motion step I7, I12 and MPRB matching step I8, I13. The results are stored into the note classification memory 194. According to a format of the note classification memory 194 shown in FIG. 37, each note record of classification comprises three bytes of a note type byte, a motion type byte and an MP match flag byte. The note type indicates a function of a note specified by a key and a corresponding chord, and is selected from among chord one, scale note, tension note, available note and avoid note type. The motion type is classified as a function of the pitch change to a succeeding note, and is selected from among terminal motion, no motion, jump up, jump down, step up and step down. The MP match flag indicates whether the note meets a melody pattern rule.

The classify note step I6, I11 uses the current note pitch class PC, current chord root ROOT and current key candidate KEY to compute DROOT and DKEY by $$DROOT=CPC+24-KEY-ROOT) \bmod 12$$

$$DKEY=(PC+12-KEY) \bmod 12$$

If DROOT is an element of the chord tone PCS, the current note type is classified into chord tone. If DKEY is an element of the scale note PCS, and if DROOT is an element of the tension note PCS, the current note is classified as the note type of available note. If DKEY is an element of the scale note PCS but if DROOT is not an element of the tension note, the note type is determined as scale note. If DKEY is not included in the scale note PCS but if DROOT is included in the tension note PCS, the current note is classified as the note type of tension note. If DKEY is not an element of the scale note PCS and if DROOT is not an element of the tension note PCS, the current note type is identified as avoid note.

The classify motion type step I7, I12 reads a note together with its succeeding note and computes the pitch difference (interval) therebetween for motion classification. Specifically, if the current note is the end note of a phrase, the motion type is determined as terminal motion. If the interval is "0" indicative of the same pitch, the motion type is identified as no motion. If the interval is "1" or "2" i.e., pitch increase of half or whole tone, the motion type is classified as step up. If the interval is greater than "2", the motion type is determined as jump up. If the interval is "−1" or "−2", i.e., pitch decrease of half or whole tone, the motion type of the current note is identified as step down. If the interval is less than "−2", the motion type is determined as jump down.

The MPRB matching step I8, I13 matches a classification note succession of the melody segment against a melody pattern in MPRB 185 (which may be identical with MPRB 84 shown in FIG. 14), and labels the note succession having matched a melody pattern with pattern-matched.

The evaluate CP suitability step I9, I14 evaluates the suitability of the chord progression by computing a propotion of those notes labeled with pattern-matched.

If the evaluated suitability reaches or exceeds an allowance value X, step I18 enters the chord progression together with its suitability.

If all chord progressions in CPDB have failed to reach the allowance value (I16, I24), the allowance value is lowered (I17, I25).

The above process repeats for all key candidates of a melody segment (I19, I20). Then, the process proceeds to the next melody segment until the process completes for all melody segments (phrases) of the memory (I21). Finally (I22), a chord progression for each phrase is determined by selecting an entered chord progression having the highest suitability for each phrase.

In this manner, the music apparatus produces a chord progression suitable for each melody phrase.

This concludes the detailed description. However, various modifications will be obvious to those skilled in the art. Therefore, the scope of the invention should be limited solely by the appended claims.

What is claimed is:

1. A analyzer comprising:

(A) melody providing means for providing a melody represented by a note succession;

(B) phrase detecting means for analyzing said note succession of said melody to thereby detect a plurality of phrases included in said melody; and (C) phrase key determining means for determining a key of each phrase of said plurality of phrases based on contents of each said phrase.

2. The melody analyzer of claim 1 wherein said melody providing means comprises:

keyboard means for inputting data of said melody in real time; and melody recording means for recording said data of said melody.

3. The melody analyzer of claim 1 wherein said phrase detecting means comprises means for detecting a phrase ending note from said melody.

4. The melody analyzer of claim 1 wherein said phrase detecting means comprises up-beat test means for testing said melody to see whether said melody starts with an up-beat.

5. The melody analyzer of claim 1 wherein said phrase key determining means comprises:

motion analyzing means for analyzing motion of a phrase; and key determining means for determining a key of said phrase based on said analyzed motion.

6. The melody analyzer of claim 5 wherein said key determining means comprises means for generating a plurality of different candidates for said key of said phrase.

7. The melody analyzer of claim 1 wherein said phrase key determining means comprises key checking means for checking whether a key of a current phrase is the same as that of a preceding phrase.

8. A melody harmonizer comprising:

(A) melody providing means for providing a melody represented by a note succession;

(B) phrase detecting means for analyzing said note succession of said melody to thereby detect a plurality of phrases included in said melody;

(C) chord progression database means for storing a database of chord progressions;

(D) chord progression assigning means for searching through said chord progression database means to thereby assign a chord progression to each phrase of said plurality of phrases;

(E) phrase key determining means for determining a key of each phrase of said plurality of phrases based on contents of each said phrase; and (F) transposing means for transposing said assigned chord progression of a phrase according to said determined key of said phrase.

9. The melody harmonizer of claim 8 wherein said phrase detecting means comprises means for detecting a phrase ending note from said melody.

10. The melody harmonizer of claim 8 wherein said phrase detecting means comprises up-beat test means for testing said melody to see whether said melody starts with an up-beat.

11. The melody harmonizer of claim 8 wherein said chord progression assigning means comprises means for generating a plurality of candidates for a chord progression of each said phrase.

12. The melody harmonizer of claim 8 wherein said chord progression providing means comprises composing means for composing a chord progression of a phrase from a plurality of chord progressions stored in said chord progression database means.

13. A melody analyzer comprising;

(A) melody providing means for providing a melody;

(B) style designating means for designating a music style;

(C) phrase database means for storing a database of phrases grouped by music styles; and (D) phrase finding means for finding a portion of said melody which matches a phrase in a phrase group of said designated music style, stored in said phrase database means.

14. A melody harmonizer comprising;

(A) melody providing means for providing a melody;

(B) style designating means for designating a music style;

(C) phrase database means for storing a database of phrases grouped by music styles;

(D) chord progression database means for storing a database of chord progressions grouped by music styles;

(E) phrase finding means for finding a portion of said melody which matches a phrase in a phrase group of said designated music style, stored in said phrase database means; and (F) chord progression search means for searching a chord progression group of said designated music style, stored in said chord progression database means, to thereby retrieve a chord progression for said portion of said melody.

* * * * *